US010115262B2

(12) United States Patent
Ashigaya et al.

(10) Patent No.: US 10,115,262 B2
(45) Date of Patent: Oct. 30, 2018

(54) ROTATING APPARATUS FOR GAME SYSTEM HAVING LIGHT-EMITTING DEVICE ATTACHED THERETO

(71) Applicant: SEGA SAMMY CREATION INC., Tokyo (JP)

(72) Inventors: Hiroki Ashigaya, Tokyo (JP); Manabu Ohmizu, Tokyo (JP); Masaki Kawabata, Tokyo (JP)

(73) Assignee: SEGA SAMMY CREATION INC., Tokyo (JP)

( * ) Notice: Subject to any disclaimer, the term of this patent is extended or adjusted under 35 U.S.C. 154(b) by 113 days.

(21) Appl. No.: 15/033,342

(22) PCT Filed: Dec. 17, 2013

(86) PCT No.: PCT/JP2013/083789

§ 371 (c)(1),
(2) Date: Apr. 29, 2016

(87) PCT Pub. No.: WO2015/092870

PCT Pub. Date: Jun. 25, 2015

(65) Prior Publication Data

US 2016/0260281 A1 Sep. 8, 2016

(51) Int. Cl.
*G07F 17/32* (2006.01)
*A63F 5/02* (2006.01)
(Continued)

(52) U.S. Cl.
CPC ..... *G07F 17/3213* (2013.01); *A63F 5/0088* (2013.01); *A63F 5/0094* (2013.01);
(Continued)

(58) Field of Classification Search
CPC ..... A63F 5/00; A63F 5/02; A63F 5/005
See application file for complete search history.

(56) References Cited

U.S. PATENT DOCUMENTS 3,090,623 A * 5/1963 Dugan ..... A63F 5/00 273/121 R
2004/0200102 A1* 10/2004 Inoue ..... G09F 13/16 40/582

(Continued)

FOREIGN PATENT DOCUMENTS

JP 06-021670 U 3/1994
JP 06-327808 A 11/1994

(Continued)

*Primary Examiner* — James S. McClellan
*Assistant Examiner* — Kevin Carter
(74) *Attorney, Agent, or Firm* — Drinker Biddle & Reath LLP

(57) ABSTRACT

A rotating apparatus for a game system having a light-emitting device includes a rotating member that rotates on a fixing member, light-irradiated areas that are partitioned and formed in a circumferential direction of the rotating member, light sources annularly arranged in the fixing member that irradiate the light-irradiated areas with light, a light-blocking body that is formed in the rotating member so as to prevent the light, with which a specific light-irradiated area as a light irradiation target out of the light-irradiated areas is irradiated, from leaking into other light-irradiated areas and adjacent to the specific light-irradiated area, and a control unit that controls a timing of changing light intensity of the light sources, and the control unit turning on and off the light sources in synchronization with the rotation of the specific light-irradiated area as the light irradiation target.

4 Claims, 30 Drawing Sheets

(51) Int. Cl.
*A63F 5/00* (2006.01)
*G07F 17/34* (2006.01)
*A63F 3/00* (2006.01)

(52) U.S. Cl.
CPC ..... *A63F 5/02* (2013.01); *G07F 17/3202* (2013.01); *G07F 17/34* (2013.01); *A63F 5/0082* (2013.01); *A63F 2003/00652* (2013.01)

(56) References Cited

U.S. PATENT DOCUMENTS

2006/0055109 A1* 3/2006 Yokota ..... A63F 5/00 273/142 R
2007/0135203 A1* 6/2007 Nicely ..... A63F 5/00 463/17
2008/0139280 A1 6/2008 Inamura
2009/0017903 A1* 1/2009 Mizoguchi ..... G07F 17/3202 463/20
2009/0316436 A1* 12/2009 Takahashi ..... G02B 6/0078 362/628
2010/0102507 A1* 4/2010 Bontempo ..... A63F 5/00 273/142 R
2010/0301557 A1* 12/2010 Kido ..... A63F 5/0005 273/142 E
2012/0115563 A1* 5/2012 Kido ..... G07F 17/3211 463/17

FOREIGN PATENT DOCUMENTS

JP 07-001980 U 1/1995
JP 07-204318 A 8/1995
JP 2001-310014 A 11/2001
JP 2002-143369 A 5/2002
JP 2003-135652 A 5/2003
JP 2004-198879 A 7/2004
JP 2005-111014 A 4/2005
JP 2005-245608 A 9/2005
JP 2006-055524 A 3/2006
JP 2008-119296 A 5/2008
JP 4302699 B2 7/2009
JP 2011-234936 A 11/2011

* cited by examiner

ROTATING APPARATUS FOR GAME SYSTEM HAVING LIGHT-EMITTING DEVICE ATTACHED THERETO

CROSS-REFERENCE TO RELATED APPLICATION

This application is the U.S. national phase of the International Patent Application No. PCT/JP2013/083789 filed Dec. 17, 2013, the entire content of which is incorporated herein by reference.

FIELD

The present disclosure relates to a rotating apparatus for a game system having a light-emitting device attached thereto.

BACKGROUND

A roulette game in which a betting target is one of plural pockets formed in a roulette board (also referred to as a will, a wheel, or the like) into which a ball will enter has been enjoyed in a game hall or the like. The roulette body is provided with pockets having numerals of "0" and "1" to "36" attached thereto and an additional pocket of "00" in some cases, and the number of the pocket into which the ball enters is determined as a winning number.

As a system causing a player not to gradually lose interest even when a game is repeatedly played, a roulette game system is proposed which has two roulette boards arranged and gives a prize in complex consideration of the results of two games (for example, see Japanese Patent Application Laid-Open No. 2008-119296).

A multiplayer-participating novel roulette game system, for example, a roulette game system comprising a large-size roulette lottery apparatus and plural station units arranged in front of the roulette lottery apparatus, has been proposed. Each station unit is a unit allowing each player to perform a betting (BET) operation in a roulette game. In such a multiplayer-participating novel roulette game system, if the roulette lottery apparatus can be viewed from any station unit, a sense of togetherness is created similarly to general roulette games and interest specific to the roulette game is created. In this way, in order to view the roulette lottery apparatus from any station unit, for example, a configuration in which a rotation plane of a roulette board stands upright to achieve an easy view or the like can be considered. As means for causing a winning number in the roulette board to be more conspicuous, a configuration allowing a numeral of a pocket, into which a ball enters, to shine or the like can also be considered.

However, when light sources corresponding to numerals are arranged to cause the numerals of the rotating roulette board to shine, the light sources rotate along with the roulette board. Accordingly, a rotary connector (rotational-connecting connector) such as a slip ring is required and the number of components increases to thereby complicate the configuration, which is disadvantageous in terms of durability of the connector or the like.

Therefore, an object of the present disclosure is to provide a rotating apparatus for a game system of a novel configuration having a light-emitting device attached thereto.

SUMMARY

In order to achieve the above-mentioned object, embodiments provide a rotating apparatus for a game system having a light-emitting device attached thereto, comprising:

a rotating member that rotates on a fixing member;

a drive source that causes the rotating member to rotate;

plural light-irradiated areas that are partitioned and formed in a circumferential direction of the rotating member;

plural light sources that are arranged in an annular shape in the fixing member to configure the light-emitting device and that irradiate the light-irradiated areas with light;

a light-blocking body that is formed in the rotating member so as to prevent the light, with which a specific light-irradiated area as a light irradiation target out of the plural light-irradiated areas is irradiated, from leaking into other light-irradiated areas adjacent to the specific light-irradiated area; and a control unit that controls a timing of changing light intensity of the light sources, wherein the control unit changes the light intensity of the light sources in synchronization with the rotation of the specific light-irradiated area as the light irradiation target.

In the rotating apparatus having a light-emitting device attached thereto, the plural light sources are fixed in a circumferential shape and do not rotate along with the rotating member. Accordingly, components such as a rotary connector (rotational-connecting connector) required for a structure in which light sources rotate are not necessary, it is possible to prevent an increase in the number of components into being complicated, and it is also possible to avoid problems in reliability or durability of the connector.

In the rotating apparatus having a light-emitting device attached thereto, since the timing of changing the light intensity of the light sources is controlled and is synchronized with a specific light-irradiated area using the control unit, the light sources are fixed but the light sources seem to be integrally formed in the light-irradiated areas and to rotate along with the light-irradiated areas.

In addition, in the rotating apparatus having a light-emitting device attached thereto, the light-blocking body prevents the light, with which a specific light-irradiated area is irradiated, from leaking into other light-irradiated areas adjacent thereto. Accordingly, it is possible to cause the rotating apparatus to rotate while causing only the specific light-irradiated area to shine. Particularly, in the rotating apparatus having a light-emitting device attached thereto according to an embodiment having the above-mentioned configuration, the rotating member smoothly (continuously) moves rotationally and the light of the light source desired to follow the rotational movement follows the light-irradiated area of the rotating member while moving in a step-like shape (discontinuously) in a lighting range by repeatedly changing the light intensity. Therefore, when following precision (synchronization precision) is poor, the light may leak into other light-irradiated areas adjacent thereto, but the leakage can be prevented in an embodiment.

In an embodiment, the control unit changes the light intensity of the light sources at the timing of overlapping the light-blocking body with the corresponding light sources when changing the light intensity of the light sources in synchronization with movement of the rotating member. According to this rotating apparatus, it is possible to satisfactorily prevent light from leaking into the adjacent light-irradiated areas.

In the rotating apparatus, it is preferable that the light-blocking body be formed in a shape extending in the circumferential direction of the rotating member. When the width (length or thickness in the rotating direction) of the light-blocking body is large, the timing of changing the light intensity of the corresponding light source has a similar width and can be more easily controlled. Accordingly, even when the control of changing the light intensity of the light source does not have high precision, it is possible to control the turning-off of the light source while preventing leakage of light.

In the rotating apparatus, it is preferable that a part of the light-blocking body be formed in a shape protruding from the rotating member to the light sources. The part protruding to the light sources serves as a cap (awning) so as to more satisfactorily prevent light from leaking into other light-irradiated areas.

In the rotating apparatus according to an embodiment, a light-transmitting member that transmits a part of light emitted from the light sources may be disposed in the light-irradiated areas. According to this rotating apparatus, the light-irradiated area transmitting the light seems to shine due to the light transmitted by the light-transmitting member.

In the rotating apparatus, it is more preferable that a light-diffusing member that diffuses light emitted from the light sources be disposed in the light-irradiated areas between the light-transmitting member and the light sources. According to this rotating apparatus, since light is diffused in the light-irradiated area by the operation of the light-diffusing member, the light intensity in the light-irradiated area is made to be constant.

It is preferable that the light-irradiated areas be equally partitioned in the circumferential direction of the rotating member. In this case, the light intensity can be changed at the same timing for all the light-irradiated areas.

According to an embodiment, it is possible to provide a rotating apparatus for a game system of a novel configuration having a light-emitting device attached thereto.

DETAILED DESCRIPTION

Hereinafter, the configuration of an embodiment will be described in detail in conjunction with embodiments illustrated in the accompanying drawings.

Figure 1:
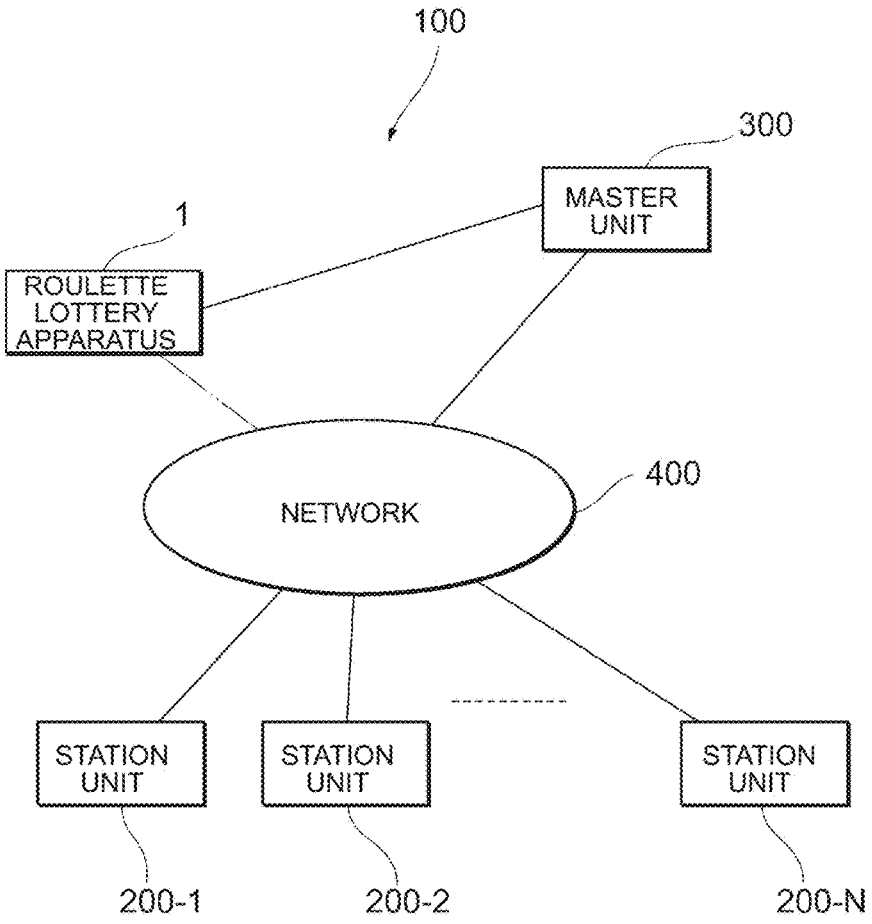
FIG. 1 is a diagram schematically illustrating a configuration of a roulette game system according to an embodiment.

A game system 100 according to an embodiment comprises a roulette lottery apparatus 1 which is a main lottery machine (a main apparatus), plural station units 200-N (where N is a natural number of 2 or greater) for causing a player to perform a betting operation in a roulette game, and a master unit 300 for controlling the roulette lottery apparatus 1 and the station units 200-N (see FIG. 1). The game system 100 according to this embodiment further comprises a side monitor 500 (see FIG. 4 and the like).

In the game system 100, a large-size roulette lottery apparatus 1 is employed, and plural station units 200-N are arranged in front of the roulette lottery apparatus 1, and a novel and interesting game in which multiple players simultaneously enjoy the same roulette game (a game based on a lottery result using a single roulette lottery apparatus 1) is provided. In the below description, a side (side on which the station units 200-N are arranged) on which players are located when viewed from the roulette lottery apparatus 1 is defined as a front side and the opposite side thereof is defined as a rear side, whereby the front-and-rear direction is defined (see FIG. 8). A direction perpendicular to the front-and-rear direction (direction connecting the front surface and the rear surface) in the horizontal plane is a right-and-left direction.

The roulette lottery apparatus 1 and the master unit 300 are connected to each other and the master unit 300 and the station units 200-N (hereinafter, simply referred to as "station unit 200" when the station units do not need to be identified) are connected to each other via a network 400 such as a local area network (LAN), a wide area network (WAN), or the Internet in a wired and/or wireless communication manner. Players participating in a roulette game can perform a betting operation at the station units 200 to enjoy the game (see FIG. 3 or the like).

Figure 3:
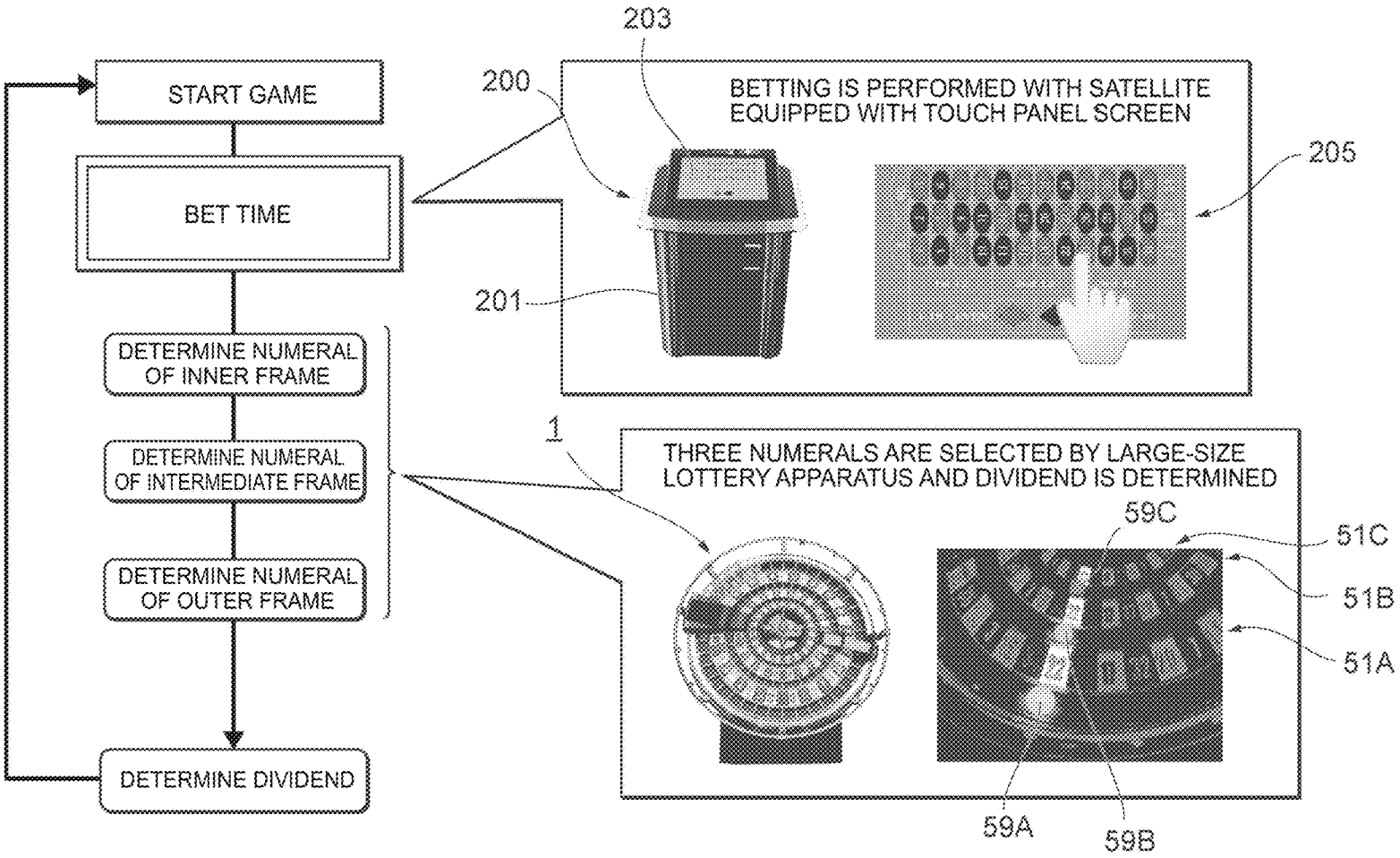
FIG. 3 is a diagram illustrating an example where a game flow in the roulette game system along with a state where a betting operation is performed with a station unit at the time of betting and a state of a roulette body or the like in a roulette lottery apparatus at the time of carrying out a lottery.

Each station unit (which may be referred to as a satellite) 200 comprises an operation housing 201 allowing a player to input an operation (see FIG. 3 or the like). In the game system 100 according to this embodiment, plural operation housings 201 are arranged on the front side of the roulette lottery apparatus 1 so that movement of the roulette bodies 51 or the balls 59 in the roulette lottery apparatus 1 and a history display unit (display) 9 can be easily viewed from any operation housing 201 (see FIGS. 4 and 5 or the like). Each operation housing 201 is appropriately provided with a game table display unit 203 (see FIG. 3 or the like) comprising a touch panel screen disposed on the top surface thereof, an operation unit 205 used for a player to move a cursor to any cell in a game table displayed on the game table display unit 203 or to touch a cell of the touch panel to bet chips, and the like (see FIG. 3 or the like). The game table display unit 203 comprises a touch-panel liquid crystal display which is display means for outputting an image of a game field. For example, command keys are appropriately displayed on the liquid crystal display with the progress of a game and various command signals are input to a game control circuit by causing a player to directly touch the touch panel over the command keys with a hand. In the game system 100 according to this embodiment, a betting table in a roulette game is displayed on the game table display unit 203 (see FIG. 3).

The side monitor 500 appropriately displays a history of a game or the like.

The roulette lottery apparatus 1 is a main apparatus in the game system 100 and performs a physical lottery in a roulette game. The roulette lottery apparatus 1 according to this embodiment comprises plural roulette bodies, for example, three roulette bodies 51A, 51B, and 51C of large, middle, and small roulette bodies which are supported to be rotatable (see FIG. 4 or the like). These three roulette bodies (large roulette body, middle roulette body, and small roulette body) 51A, 51B, and 51C are annular rotating bodies having different diameters and are configured to rotate about a rotation center line Z which is an identical virtual axis. In the below description, when description is made in common without specifying any one of the plural roulette bodies, reference numeral 51 may be simply added thereto.

Figure 8:
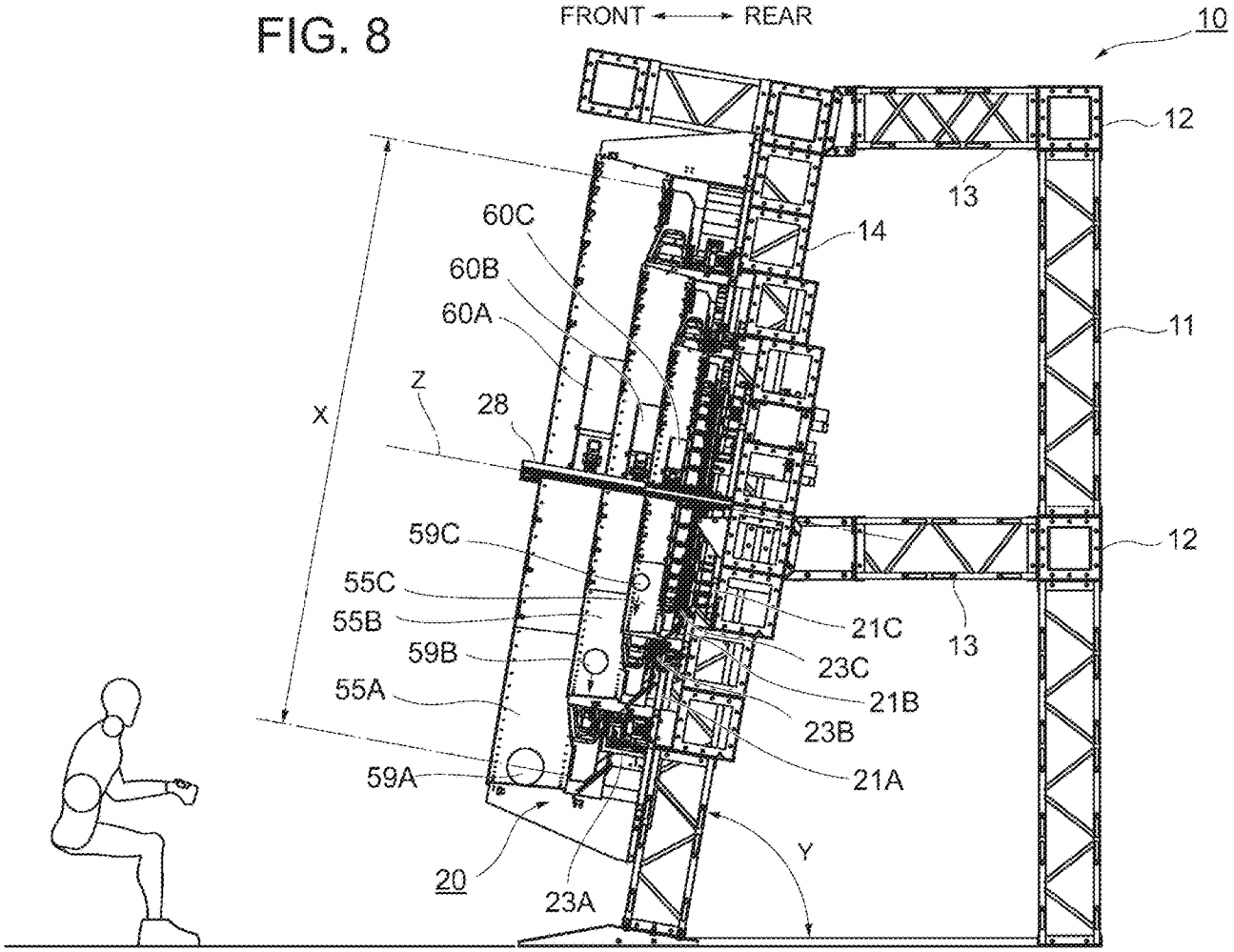
FIG. 8 is a right side view illustrating the internal structure of the roulette lottery apparatus.

The rotation plane of the three roulette bodies 51A, 51B, and 51C (the annular plane of the ball pockets 52 arranged in an annular shape) is raisable and the roulette bodies rotate about the virtual rotation center line Z which is horizontal or similar thereto (see FIG. 8 or the like). A general roulette board is configured to rotate about a vertical axis with the board surface set to be horizontal. On the contrary, in the roulette lottery apparatus 1 according to this embodiment, compared with the conventional apparatus, the rotation center line Z which is a virtual rotation axis is made to stand by Y° (for example, about 80°) and the surface (rotation plane) is similarly made to stand by Y° (see FIG. 8). The roulette lottery apparatus 1 having the configuration in which the surfaces of the roulette bodies 51A, 51B, and 51C stand in this way gives a novel impression to all spectators in addition to players.

In the roulette lottery apparatus 1 according to this embodiment, the roulette bodies 51A, 51B, and 51C are displaced along the rotation center line Z and are not flush with each other. In this way, since the roulette bodies 51A, 51B, and 51C are arranged in a stepped shape, that is, a mortar shape, and exhibit a sense of depth, the states or details of lotteries in the roulette bodies 51A, 51B, and 51C (such as the rotating states of the roulette bodies 51A, 51B, and 51C, movement of the ball 59, states in which the ball 59 enters into a ball pocket 52, and a winning number determined by allowing the ball 59 to enter into a ball pocket (the numeral of the number display section 53 corresponding to the ball pocket 52)) can be easily viewed from the front position of the roulette lottery apparatus 1 and can also be easily viewed from diagonal positions (see FIG. 5 or the like). Therefore, in the game system 100 according to this embodiment, the plural station units 200 can be arranged so that the lottery states or details in the roulette bodies 51 can be easily viewed from any position (see FIGS. 4 and 5).

Figure 4:
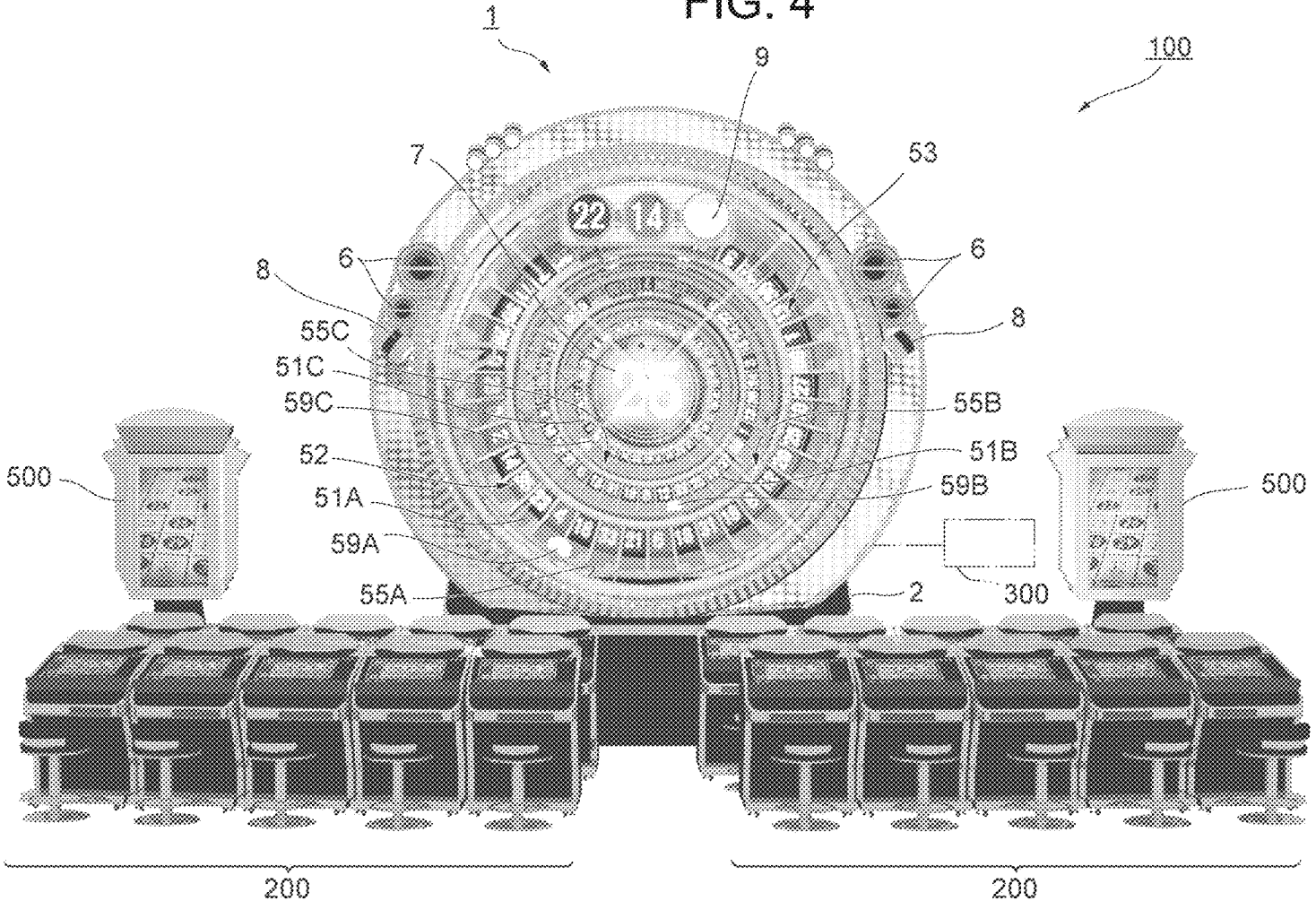
FIG. 4 is a diagram illustrating the entire roulette game system when viewed from the front side.
Figure 5:
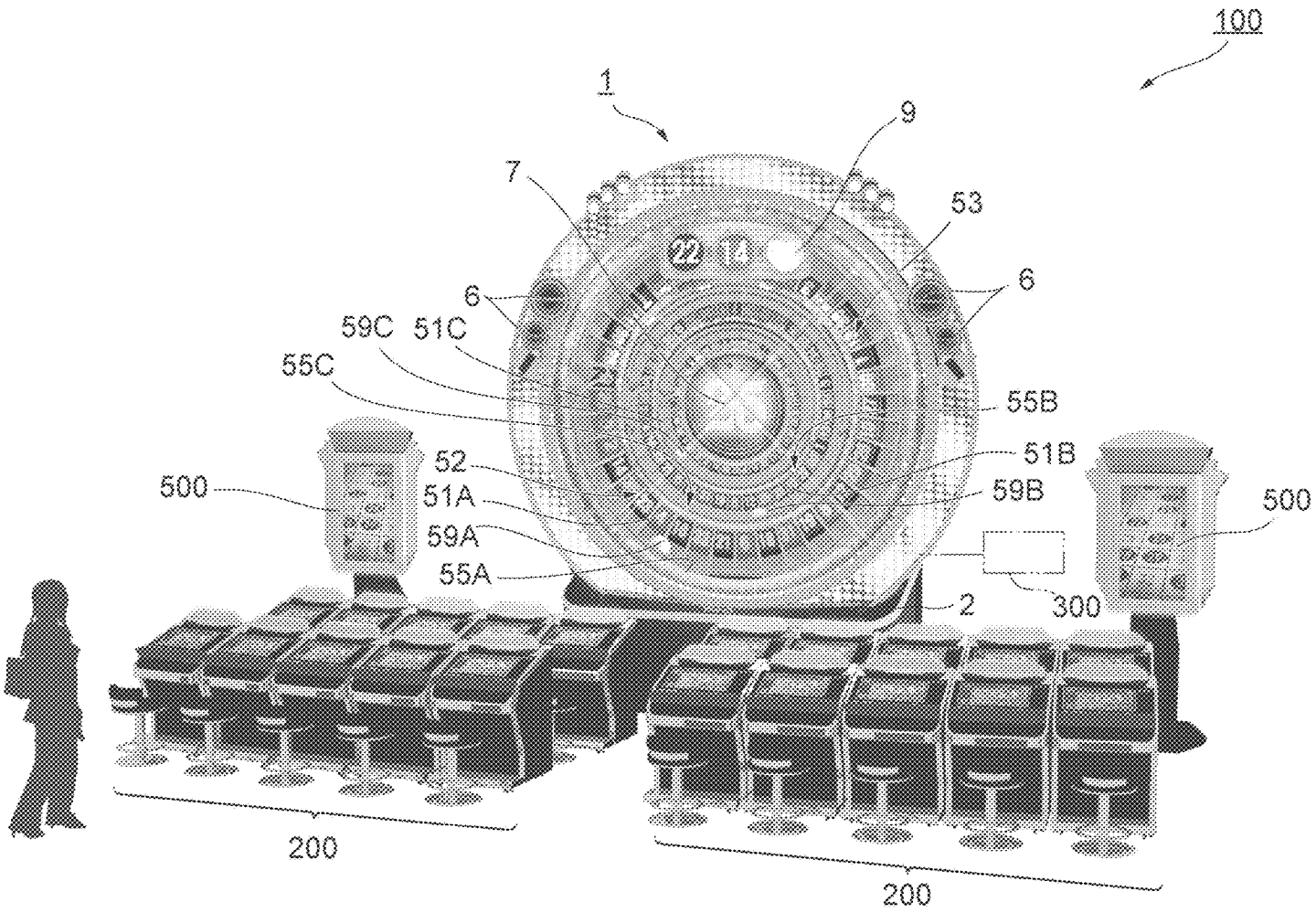
FIG. 5 is a diagram illustrating the entire roulette game system when viewed from the diagonal front side.

The specific configuration of the roulette lottery apparatus 1 will be described below (see FIG. 4 or the like).

The roulette lottery apparatus 1 according to this embodiment comprises a support frame 10, fixing members 20, rotating members 30, drive systems 40, roulette constituent members 50, ball release devices 60, ball reset devices 70, a control unit 80, and a storage unit 90 and further comprises a base 2, a camera (denoted by reference numeral 5 in FIG. 2), housing speakers 6, a central projector 7, and illumination devices 8. The control unit 80 and the storage unit 90 may be disposed in the roulette lottery apparatus 1 or may be disposed in the master unit 300, as long as they can exhibit their functions.

In the below description, when the configuration of any one (an outer large roulette body, an intermediate middle roulette body, or an inner small roulette body) of plural roulette bodies are described, signs such as A, B, and C are added to the reference signs thereof. On the other hand, when the roulette bodies are described in common without identifying any roulette body, the signs such as A, B, and C are not added thereto and only the reference numeral is described for explanation.

Support Frame 10

Figure 7:
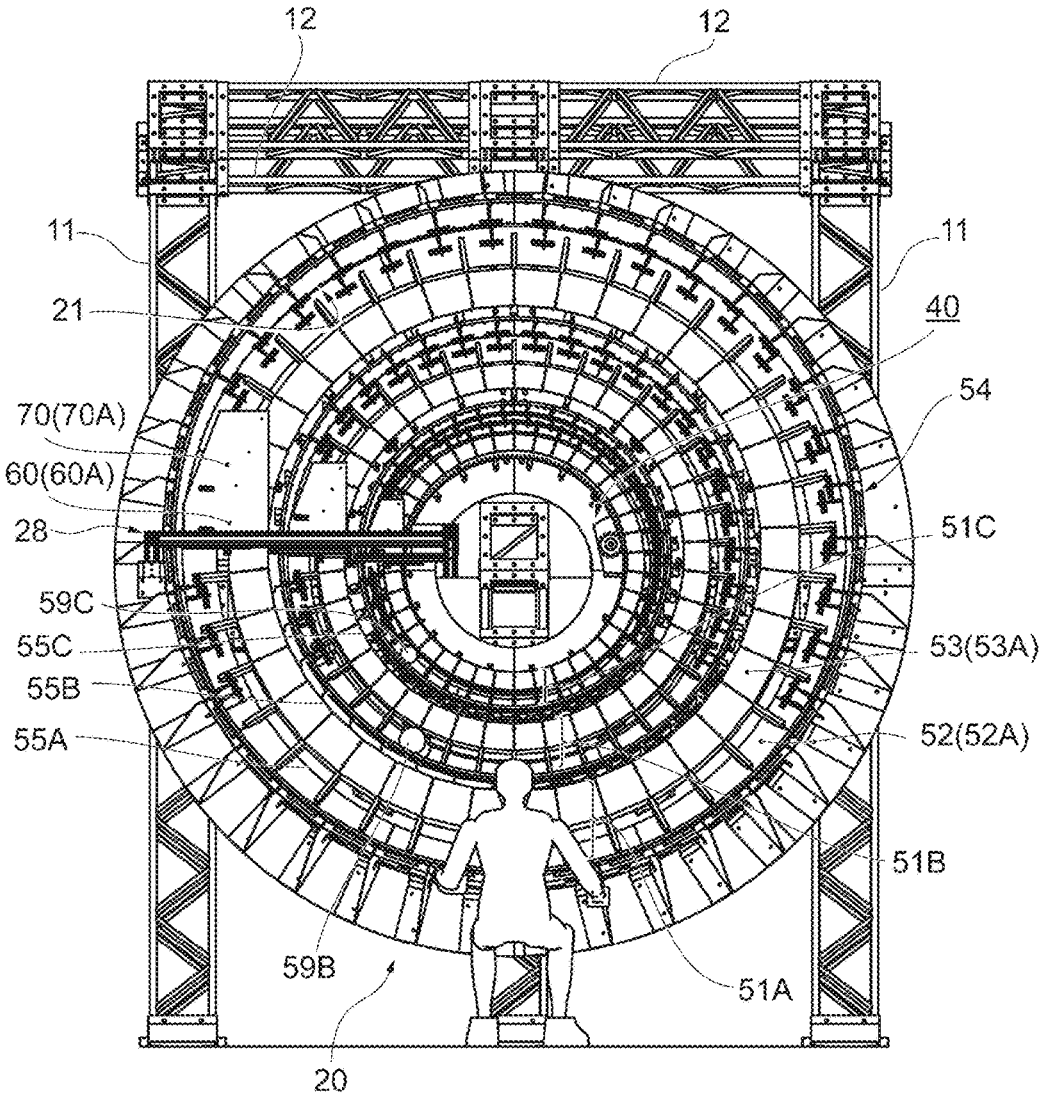
FIG. 7 is a front view illustrating an internal structure of the roulette lottery apparatus.

The support frame 10 serves as a support member supporting the fixing member 20. The support frame 10 according to this embodiment comprises a vertical frame 11 extending in the vertical direction, a horizontal frame 12 extending in the right-and-left direction, a front-and-rear frame 13 extending in the front-and-rear direction, and a tilt frame 14 slightly tilted about the vertical line (see FIGS. 7 and 8). The vertical frame 11 and the horizontal frame 12 are combined to form a door shape when viewed from the front side (see FIG. 7). The tilt frame 14 according to this embodiment is supported by the front-and-rear frame 13 in a state where it is tilted by 10° to the rear side about the vertical line (in other words, a state where it stands by 80° to the front side about the horizontal plane) (see FIG. 8). The tilt frame 14 supports the fixing members 20 from the rear side.

Fixing Member 20

Each fixing member 20 is a member configured to rotatably support the rotating member 30 comprising the roulette body. The fixing member 20 according to this embodiment comprises a wheel rail base 21, brackets 22, a wheel rail 23, and joints 24 (see FIG. 17).

The wheel rail base 21 is a part serving as a base of the fixing member 20. The wheel rail base 21 according to this embodiment is formed of an annular steel plate (see FIG. 14 or the like). Here, the annular shape is an example, and the wheel rail base may not have an annular shape and is not particularly limited as long as it is suitable for circumferentially attaching plural brackets 22. The wheel rail base 21 is fixed to the front surface side (side on which players are located) of the support frame 10 (see FIGS. 7 and 8 or the like).

The bracket 22 is a member holding the wheel rail 23. In the roulette lottery apparatus 1 according to this embodiment, plural brackets 22 are arranged in an annular shape on the wheel rail base 21 and the wheel rail 23 is held by the brackets 22 arranged in an annular shape. From the viewpoint of evenly holding the wheel rail 23, it is preferable for the plural brackets 22 to be arranged at equal intervals.

For example, the brackets 22 are installed to be movable in the radial direction and it is preferable for the positions of the brackets in the radial direction to be adjustable. As will be described later, the possibility that the wheel rail 23 in this embodiment will be completely circular is very low and there is a possibility that unevenness in shape by products will occur. When the wheel rail 23 should be held, it is considered that the plural brackets 22 are individually movable in the radial direction. Then, whatever the wheel rail 23 is and in whatever direction the wheel rail 23 is held (in other words, at what clock position one point on the wheel rail 23 is located), it is possible to handle the situations by adjusting the individual positions of the brackets. The positions of the brackets 22 at which the wheel rail 23 is held have only to be shifted in the radial direction.

For example, each bracket 22 in this embodiment can be shifted with the length of a long hole as a stroke length along the long hole. The position thereof can be fixed by fastening a bolt to an appropriate position in the stroke range.

Figure 10:
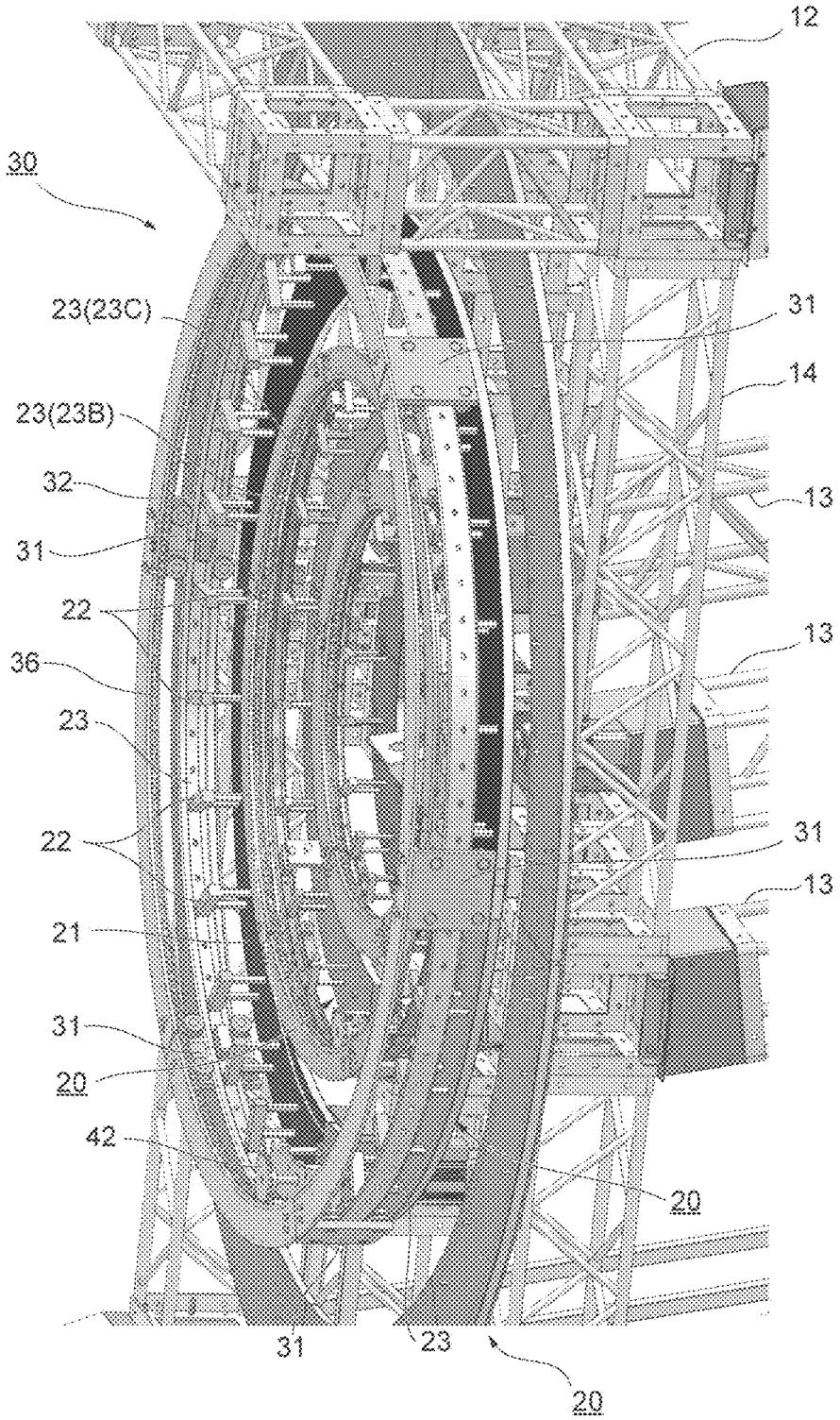
FIG. 10 is a perspective view illustrating configurations of a support frame, a fixing member, and a rotating member of the roulette lottery apparatus.
Figure 16:
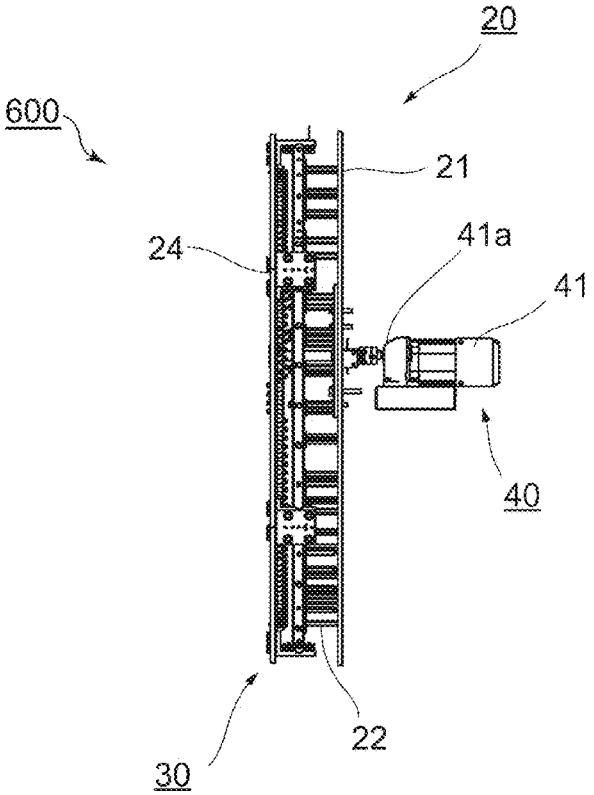
FIG. 16 is a side view illustrating the fixing member and the rotating member along with the drive system.
Figure 20:
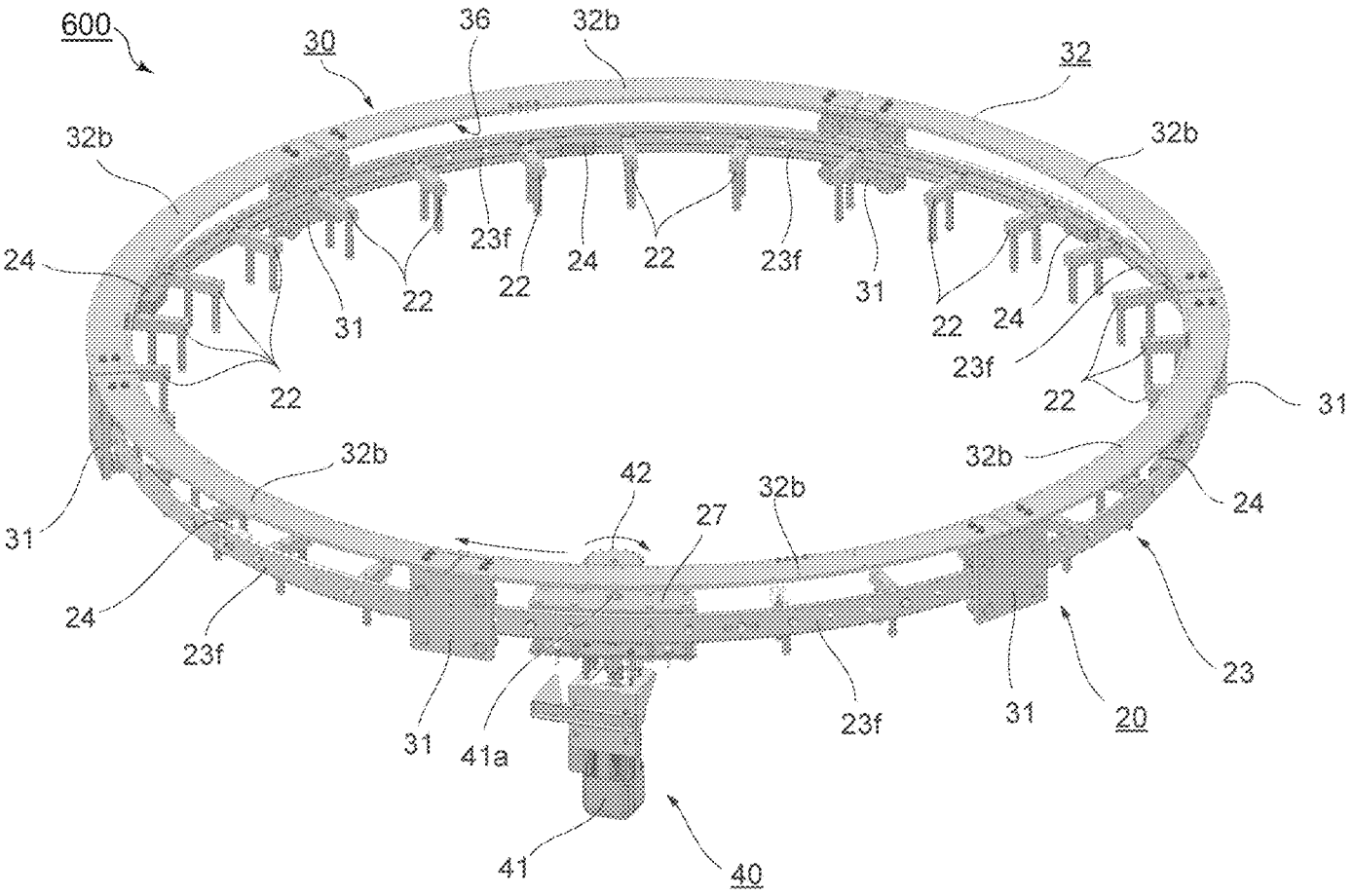
FIG. 20 is a perspective view illustrating the fixing member and the rotating member along with the drive system.

The wheel rail 23 is an annular member fixed to the wheel rail base 21 with the brackets 22 and constitutes an annular guide rail when the rotating member 30 rotates (see FIGS. 10 and 16 and the like). The wheel rail 23 according to this embodiment is formed by connecting six arc-like fixing members **23*f* with a central angle of 60°, which are obtained by dividing an annular member into six parts, in an annular shape with total six joints 24 (see FIGS. 18 and 20** and the like).

In the roulette lottery apparatus 1 according to this embodiment (of which the specific size will be described later) which has a large size and which employs the roulette bodies 51 being raisable, particular problems may occur when the respective roulette bodies 51 are rotatably supported. That is, the problems are as follows.

When the roulette bodies 51 having large weights are supported with one center axis (spindle), strength corresponding thereto is required and an increase in size and weight is necessarily caused. When multiple (for example, three) roulette bodies 51 are arranged coaxially, this problem is further actualized.

When the plural roulette bodies 51 are rotatably held without using the center axis (spindle), for example, means for rotatably holding the roulette bodies 51 such as an annular guide can be used. However, when the annular guide capable of holding the very large roulette bodies 51 is molded, it is difficult to make the annular guide completely circular and the molding cost increases.

Even when a unified annular guide which is almost completely circular is molded, labors and costs are required for carrying or assembling thereof.

In consideration of such various points, in this embodiment, the wheel rail 23 is formed by combining plural arc-like fixing members **23*f* at wheel rail junctions. For example, in this embodiment, six arc-like fixing members 23*f* with a central angle of 60° obtained by dividing an annular member into six parts are connected in an annular shape using six joints 24 to form the wheel rail 23. When end faces of the plural arc-like fixing members 23*f* are bonded to each other to form an annular shape, the annular shape is not completely circular, but a deviation in circumferential length by products is small and the circumferential length is considered to be almost constant by using the arc-like fixing members 23*f* having the same arc shape. Therefore, even when the shape is strained, it is possible to form the wheel rail 23** which is approximate to a complete circle and which has an almost constant circumferential length.

In other words, in this embodiment, when the sizes, structures, and the like of the roulette lottery apparatus 1 and the roulette bodies 51 are employed, it is difficult to avoid occurrence of strain due to an attachment error and thus the fixing member 20 is formed on the premise that the wheel rail 23 is not completely circular. In the rotating member 30 rotationally moving along the noncircular wheel rail 23 in which a strain is generated in this way, the carriage 31 can be made to smoothly rotate along the wheel rail 23 by constructing a strain absorbing mechanism as will be described later.

In addition, since the roulette bodies 51 are configured to rotate along the annular rail to make a central rotation axis (spindle) unnecessary, a monitor (for example, a central projector 7) or the like may be arranged in the center of the rotating roulette bodies 51 in the roulette lottery apparatus 1 according to this embodiment.

Since the arc-like fixing members **23*f* according to this embodiment are obtained by bending a band-like member formed of a thin plate in an arc shape, it is advantageous in terms of a decrease in weight. In this embodiment, the carriage 31 is configured to move by pinching the wheel rail 23 comprising the arc-like fixing members 23*f*** from both sides and thus it is easy to secure strength.

Figure 17:
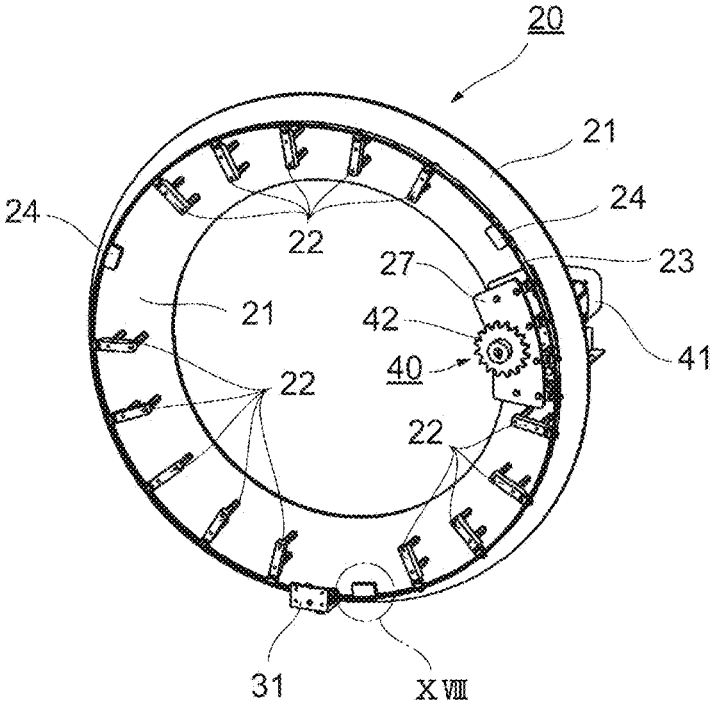
FIG. 17 is a perspective view illustrating the fixing member along with the drive system.
Figure 18:
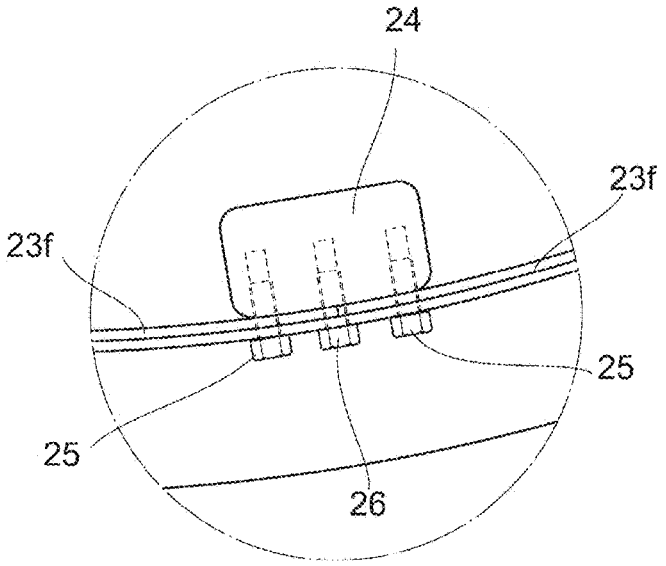
FIG. 18 is an enlarged view of a wheel rail junction indicated by reference sign XVIII in FIG. 17.

FIG. 18 is an enlarged view of a wheel rail junction indicated by reference sign XVIII in FIG. 17. The joint 24 is a member connecting the arc-like fixing members **23*f* to each other. The joint 24 according to this embodiment connects the ends of the neighboring arc-like fixing members 23*f* to each other from the inner circumference side in a state where the end faces of the arc-like fixing members come in contact with each other. As the joint 24, for example, a joint connecting the arc-like fixing members 23*f* by inserting screws 25 into through-holes of the arc-like fixing members 23***f* from the outer circumference side and fastening the screws to the joint body on the inner circumference side can be used. The joint 24 according to this embodiment has a shape and a size enough not to interfere with the movement of the carriage 31 revolving along the wheel rail 23.

Figure 19:
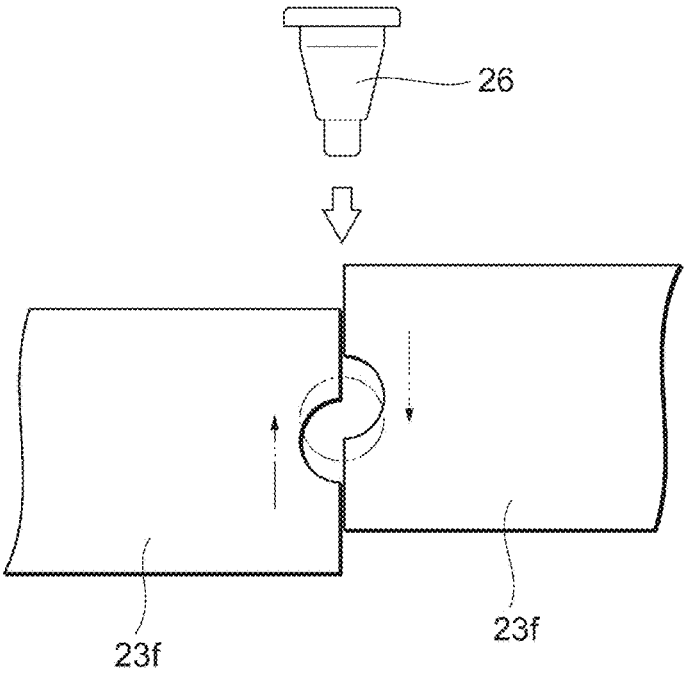
FIG. 19 is a diagram illustrating an operation of an adjustment screw in the wheel rail junction.

It is more preferable that the joint 24 is configured to correct the relative misalignment between the end faces while the end faces come in contact with each other, for example, by fastening an adjustment screw 26 having a taper shape. For example, when a semicircular hole is formed in each end face of the arc-like fixing members 23*f* and the adjustment screw 26 having a taper shape is inserted into the hole to form a circle with a pair of semicircular holes, it is possible to correct the misalignment between both end faces (misalignment in the front-and-rear direction of the roulette lottery apparatus 1 in this case) (see FIG. 19).

The roulette lottery apparatus 1 comprises three fixing members 20 having the above-mentioned configuration (see FIG. 10 and the like). The three fixing members 20 are configured to have different sizes corresponding to the large roulette body 51A, the middle roulette body 51B, and the small roulette body 51C, respectively.

Figure 12:
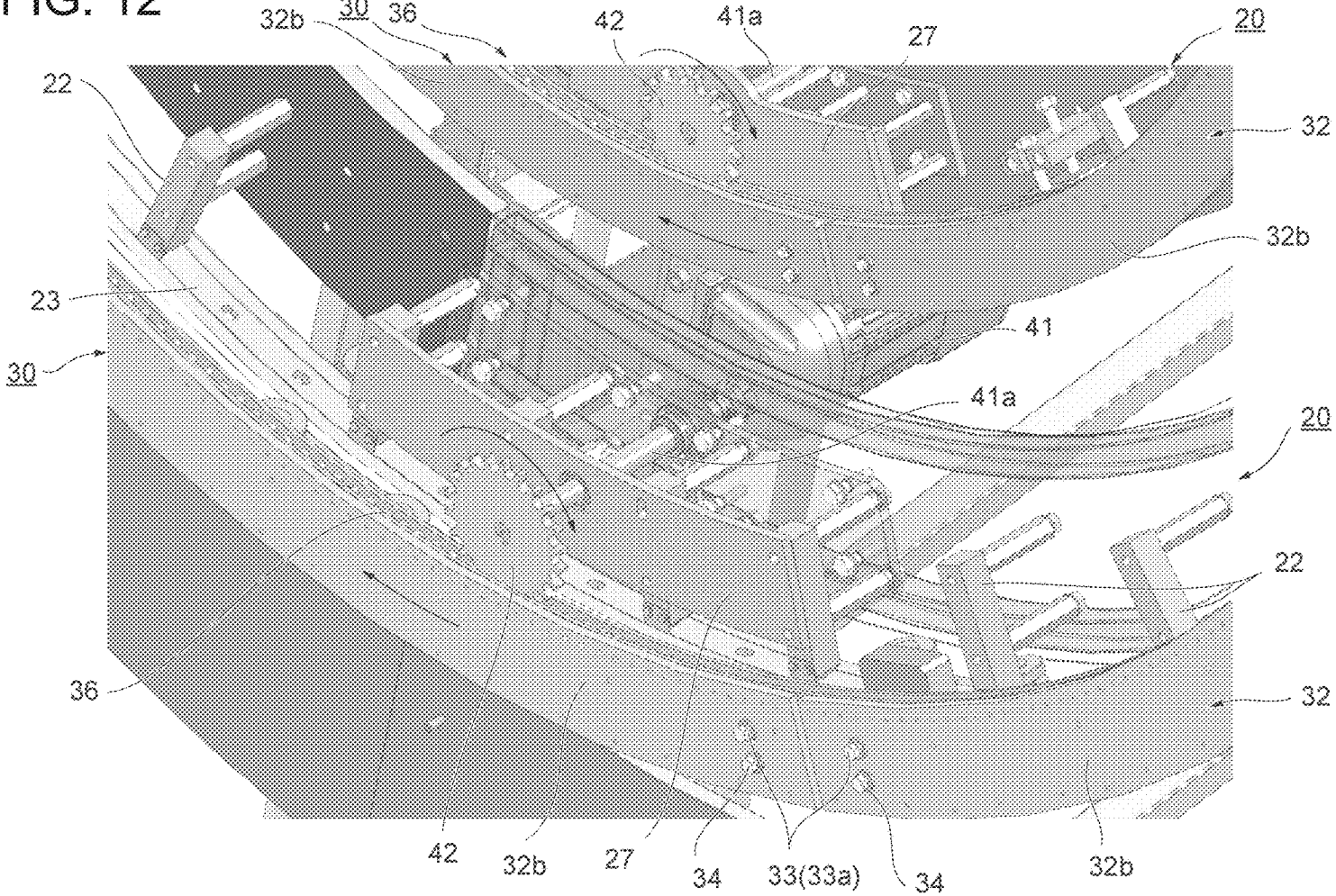
FIG. 12 is an enlarged view illustrating a configuration around a drive system of a rotating member.

The output bearing member 27 is a member serving as a bearing of an output shaft 41*a* of a roulette body drive motor 41 as an output source. The output bearing member 27 according to this embodiment is attached to a part of the fixing member 20, for example, the wheel rail 23 or the like and serves as a bearing of the output shaft 41*a* of the roulette body drive motor 41. The output bearing member 27 according to this embodiment is formed of a pair of plate-like members facing each other and having holes through which the output shaft 41*a* passes (see FIG. 12 and the like), but this is only a preferable example and other configurations may be employed.

Rotating Member 30

The rotating member 30 is a member rotating along the fixing member 20 to cause the roulette body 51 to rotate. The rotating member 30 according to this embodiment comprises a carriage 31, an annular rotating body 32, and a pin gear wheel 36 (see FIG. 20 and the like).

Figure 22:
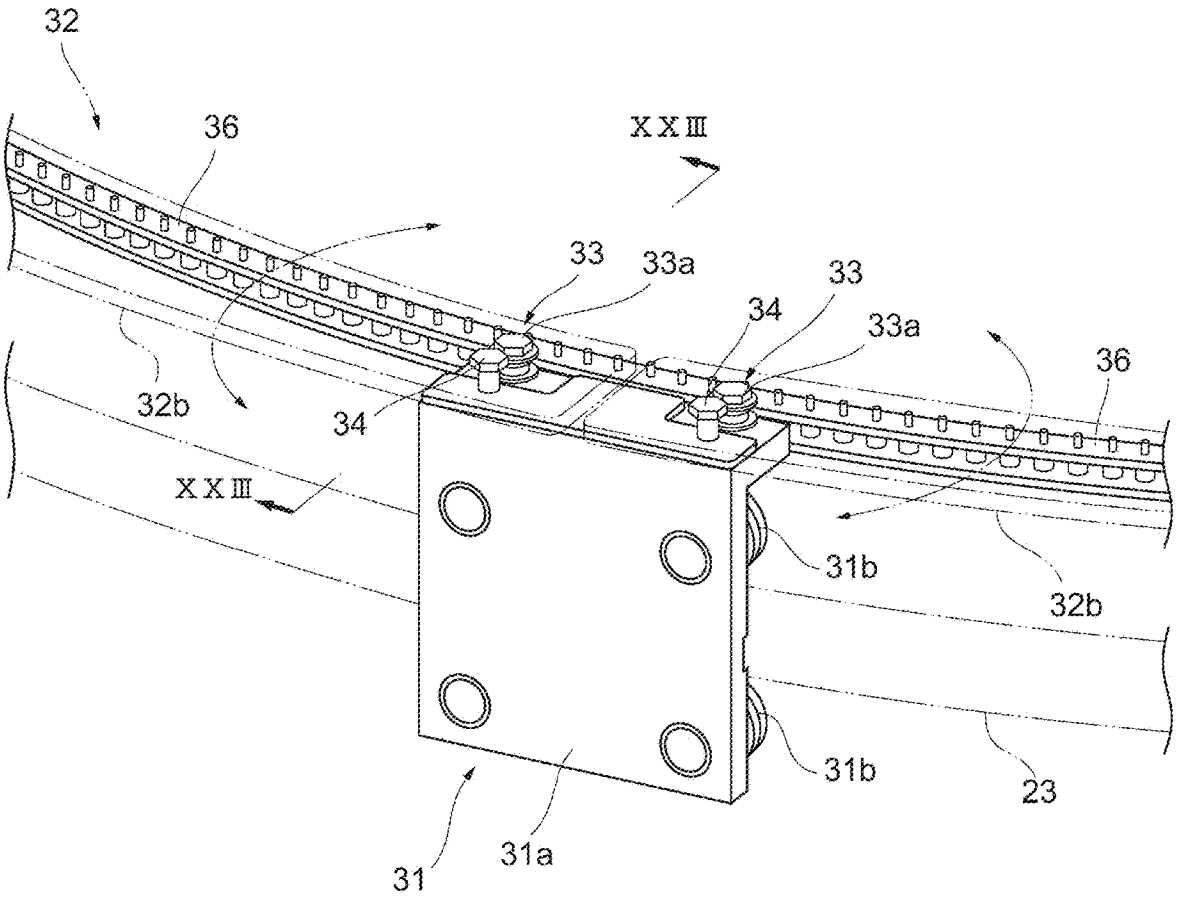
FIG. 22 is an enlarged view illustrating an inner carriage of the rotating member and a neighboring part thereof.

The carriage 31 is a member disposed to be movable along the wheel rail (guide rail) 23 while supporting the annular rotating body 32. The carriage 31 according to this embodiment comprises a base 31*a* and rollers 31*b* and is configured to move on the outer circumferential surface side of the wheel rail 23 (see FIG. 20 and the like). The annular rotating body 32 is attached to the carriage 31 so as to be relatively rotatable (see FIG. 22 and the like).

The base 31*a* is formed of a plate-like member. Total four rollers 31*b* of two pairs are arranged at four corners of the base 31*a*. A V-shaped groove is formed in each roller 31*b* (see FIG. 23) so as not to drop from the edge of the wheel rail 23. The rollers 31*b* are arranged to pinch both edges of the wheel rail 23 using the V-shaped groove. Since the wheel rail 23 is pinched between two pairs of rollers 31*b* arranged in the progressing direction, the carriage 31 can progress while stabilizing the posture without causing yawing in the progressing direction (see FIG. 20 and the like).

The annular rotating body 32 is a member disposed to form a circular shape as a whole and to constitute the rotating member 30 and formed of, for example, aluminum. The annular rotating body 32 according to this embodiment are formed by six arc-like rotating members 32*b* with a central angle of 60° obtained by dividing an annular plate-like member into six parts (see FIG. 20 and the like). Both ends of each arc-like rotating member 32*b* are rotatably held by the carriage 31.

A structure for rotatably holding the arc-like rotating members 32*b* in the carriage 31 will be described below in detail (see FIG. 23 and the like).

The arc-like rotating members 32*b* are attached to the base of the carriage 31 so as to be rotatable about the rotation axis 33. More specifically, a pin 33*a* passes through a through-hole 32*c* formed in the arc-like rotating member 32*b* and the tip of the pin 33*a* is inserted into a pin hole 31*c* of the base 31*a*. A washer 33*b* is interposed between the head of the pin 33*a* and the arc-like rotating member 32*b*. A sleeve 33*c* is fitted onto the outer circumference of the pin 33*a*. By employing this configuration, the arc-like rotating member 32*b* is rotatable (or swingable) in the right-and-left direction (more specifically, a swinging direction to the inner circumference side and the outer circumference side with respect to the tangent direction of the annular rotating body 32) about the center axis (that is, rotation axis 33) of the pin 33*a* (see FIGS. 21 and 22).

Figure 23:
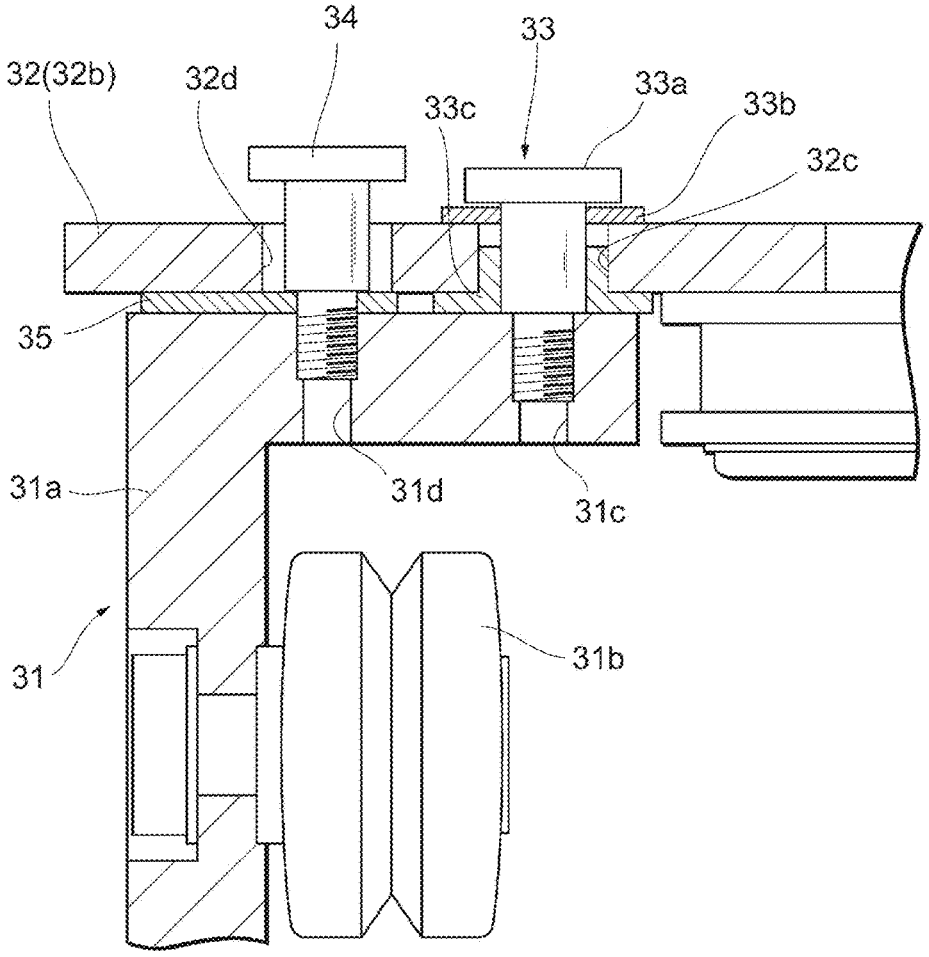
FIG. 23 is a partial cross-sectional view of a carriage and a neighboring part thereof taken along line XXIII-XXIII of FIG. 22, which illustrates the strain absorbing mechanism.

In the arc-like rotating member 32*b*, another through-hole 32*d* is formed in the vicinity of the through-hole 32*c*, and a stopper pin 34 passes through the through-hole 32*d* (see FIG. 23). The tip of the stopper pin 34 is inserted into another pin hole 31*d* formed in the arc-like rotating member 32*b*. The diameter of the head of the stopper pin 34 is larger than that of the through-hole 32*d* and the arc-like rotating member 32*b* is prevented from dropping from the carriage 31 even when the pin 33*a* is pulled out in the course of rotating movement. The through-hole 32*d* is larger than the shaft portion of the stopper pin 34 and a clearance (looseness) is formed therebetween. Accordingly, the stopper pin 34 or the through-hole 32*d* does not interfere with the relative rotation (swinging) of the arc-like rotating member 32*b* to the carriage 31, but regulates a rotatable (swingable) range (the length of the swinging stroke) depending on the size (length) of the through-hole 32*d*.

A lubricating member 35 is interposed between the base 31*a* of the carriage 31 and the arc-like rotating member 32*b* (see FIG. 23). The lubricating member 35 serves to further lubricate the relative rotating (swinging) operation of the arc-like rotating member 32*b* relative to the carriage 31 and is formed of, for example, a porous member in which lubricant is impregnated. From the viewpoint that the relative rotating (swinging) operation of the arc-like rotating member 32*b* relative to the carriage 31 is more lubricated, the washer 33*b* and the sleeve 33*c* also serve as the lubricating member (see FIG. 23).

Figure 21:
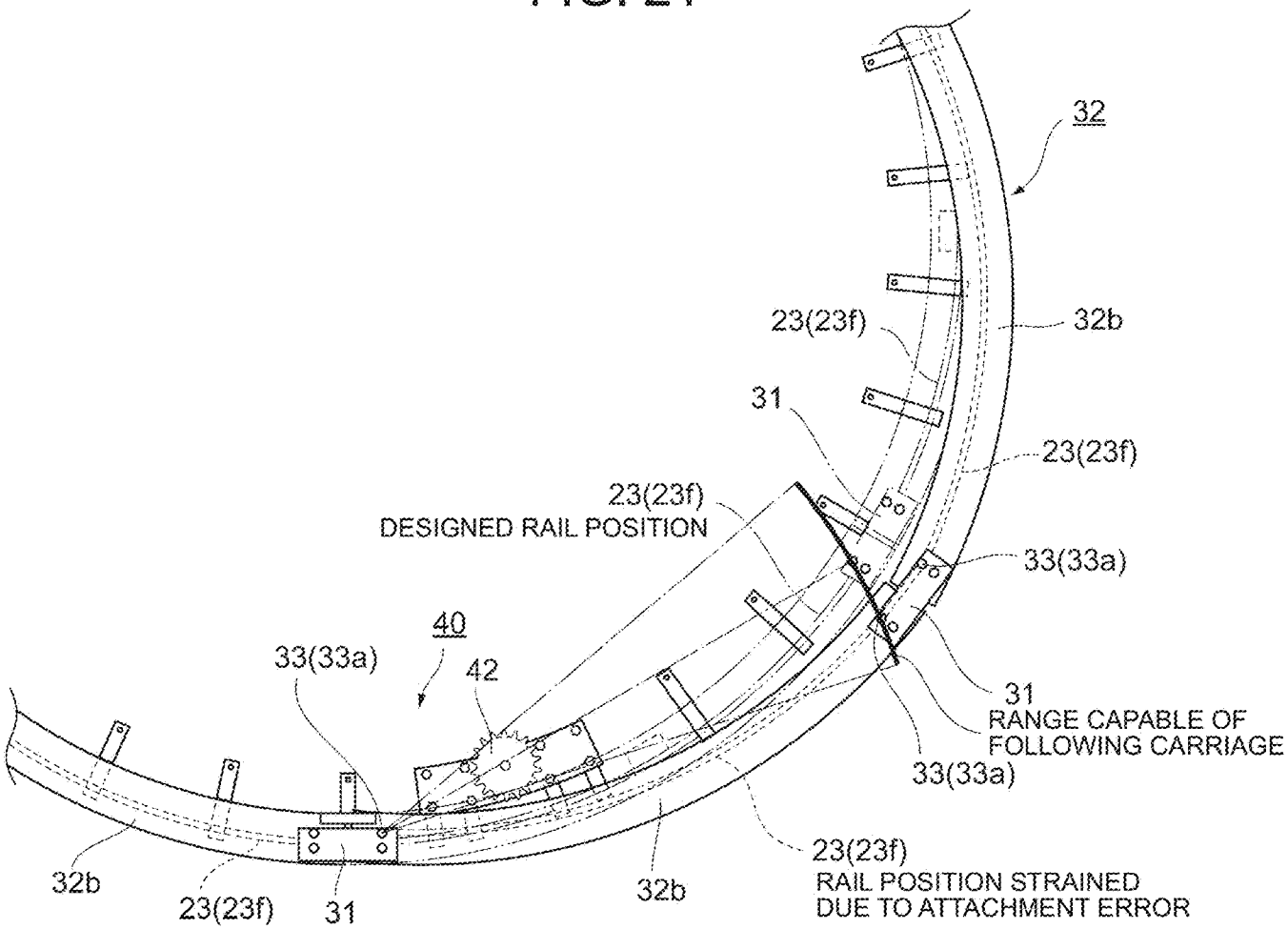
FIG. 21 is a diagram illustrating a strain absorbing mechanism in the fixing member and the rotating member.

As described above, a mechanism (strain absorbing mechanism) enabling to absorb strain is configured by holding the arc-like rotating member 32*b* so as to be rotatable relative to the carriage 31 (see FIG. 21). That is, even when the actual position of the wheel rail 23 is misaligned with the designed position (complete circle) of the wheel rail 23 due to strain based on an attachment error, the arc-like rotating member 32*b* relatively rotates in a predetermined range relative to the carriage 31 and it is thus possible to track the misaligned orbit of the carriage 31. In brief, when the orbit of the carriage 31 is not completely circular but is not severely strained, the arc-like rotating members 32*b* track the movement of the carriage 31 to exclude the influence of the strain. By employing this strain absorbing mechanism, the smooth revolving movement of the carriage 31 on the wheel rail 23 is not hindered.

The rotating member 30 is provided with a driving force receiving section receiving the drive force of the drive system 40. In the roulette lottery apparatus 1 according to this embodiment, the drive force receiving section is formed of the pin gear wheel 36 disposed on the inner circumference of the annular rotating body 32 (see FIGS. 14 and 22 and the like). The pin gear wheel 36 comprises, for example, a pair of rails and plural pins arranged at equal intervals between the rails (see FIG. 22 and the like). In the roulette lottery apparatus 1 according to this embodiment, the pin gear wheel 36 is disposed on the inner circumference side of the annular rotating body 32.

The rotating member 30 having the above-mentioned configuration constitutes the rotating roulette body 51. In the roulette lottery apparatus 1 according to this embodiment, three types of roulette bodies of the large roulette body 51A, the middle roulette body 51B, and the small roulette body 51C having different diameters are configured to be coaxial about the rotation center line Z and to be displaced along the line direction of the rotation center line Z and constitute so-called triple ring rotating bodies.

Drive System 40

The drive system 40 comprises a roulette body drive motor 41, a sprocket 42, and an encoder 43.

The roulette body drive motor 41 is a drive source for allowing the rotating member 30 to rotate. The roulette body drive motor 41 according to this embodiment causes the rotating member 30 to rotate via the sprocket 42 disposed on the output shaft 41*a* and the pin gear wheel 36.

The sprocket 42 is disposed on the output shaft 41*a* of the roulette body drive motor 41 and transmits the drive force of the roulette body drive motor 41 to the pin gear wheel 36. The output shaft 41*a* is received by the output bearing member 27 attached to the wheel rail 23 (see FIG. 12 and the like).

The encoder 43 is a member for encoding the degree of rotation of the rotating member 30. In this embodiment, the rotation shaft of the roulette body drive motor 41 is provided with the encoder 43 and the degree of rotation of the rotating member 30 is detected on the basis of the degree of rotation of the roulette body drive motor 41 (see FIG. 12 and the like). As described above, in the roulette lottery apparatus 1 according to this embodiment, since the drive force is transmitted to the annular rotating body 32 so as to rotate via the sprocket (pin gear) 42 and the pin gear wheel 36, slip does not occur between the sprocket 42 and the pin gear wheel 36. Accordingly, by reading the degree of rotation of the rotation shaft of the roulette body drive motor 41, that is, the degree of rotation of the sprocket 42, it is possible to detect the degree of rotation of the annular rotating body 32 which corresponds to the degree of rotation of the sprocket 42 in a one-to-one relationship.

As another configuration for detecting the degree of rotation of the rotating member 30, the annular rotating body 32 may be provided with an encoder and the degree of rotation of the rotating member may be directly detected using the encoder rotating together with the annular rotating body 32. However, when this configuration is employed and the rotation angle of the rotating member 30 should be detected in more detail, it is necessary to increase the number of encoders (for example, the number of protrusions or concave and convex portions to be encoded) by as much. In this regard, in the roulette lottery apparatus 1 according to this embodiment, it is possible to accurately detect the degree of rotation of the annular rotating body 32 using only the encoder 43 disposed on the output shaft 41*a* of the roulette body drive motor 41.

The same number of drive systems 40 having the above-mentioned configuration as the number of rotating members 30 are provided. In this embodiment, the large, middle, and small roulette bodies (the large roulette body is denoted by reference sign 51A, the middle roulette body is denoted by reference sign 51B, and the small roulette body is denoted by reference sign 51C in FIG. 6 and the like) are provided with total three drive systems 40, respectively.

Rotating Apparatus 600

Figure 14:
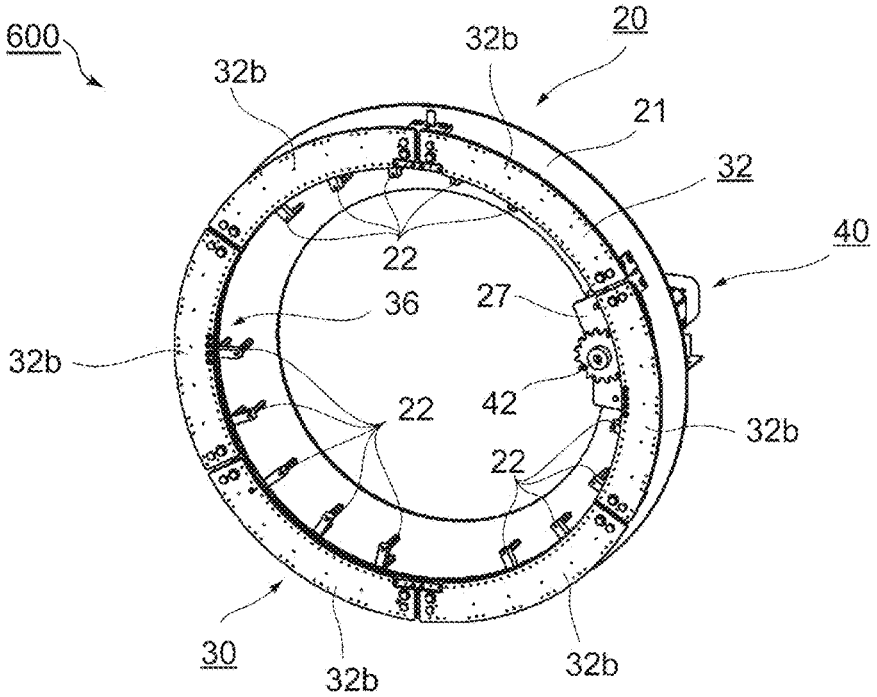
FIG. 14 is a perspective view illustrating a fixing member and a rotating member along with a drive system.
Figure 15:
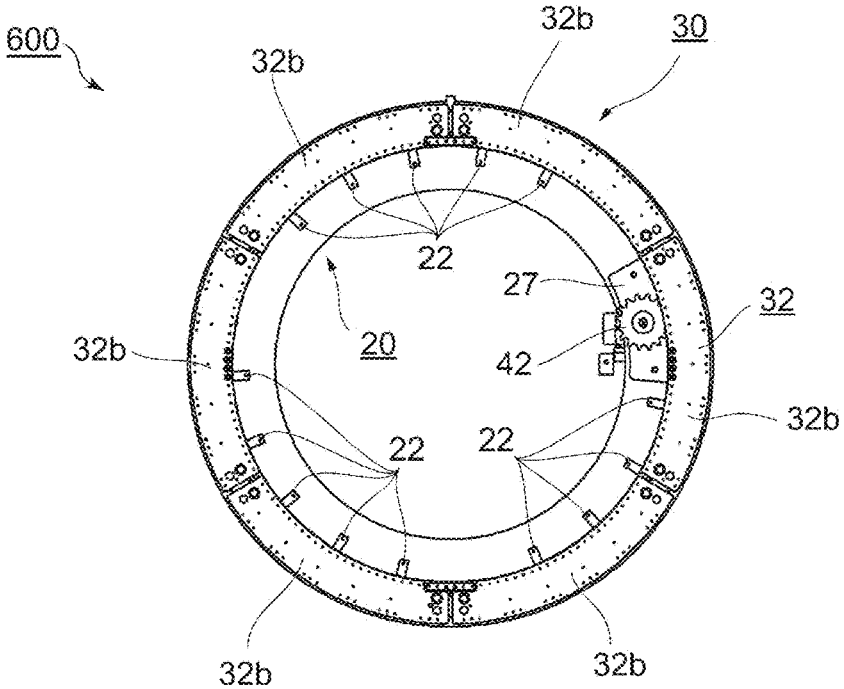
FIG. 15 is a front view illustrating the fixing member and the rotating member along with the drive system.

The wheel rail 23, the rotating member 30, the roulette body drive motor (drive source) 41, and the like configure a rotating apparatus 600 (see FIGS. 14 to 16). The rotating apparatus 600 according to this embodiment further comprises plural carriages (moving objects) 31 that moves along the wheel rail 23 and arc-like rotating members (connecting bodies) 32*b* that are disposed between the neighboring carriages 31 and that are rotatably connected to the carriages 31.

Roulette Constituent Member 50

Figure 11:
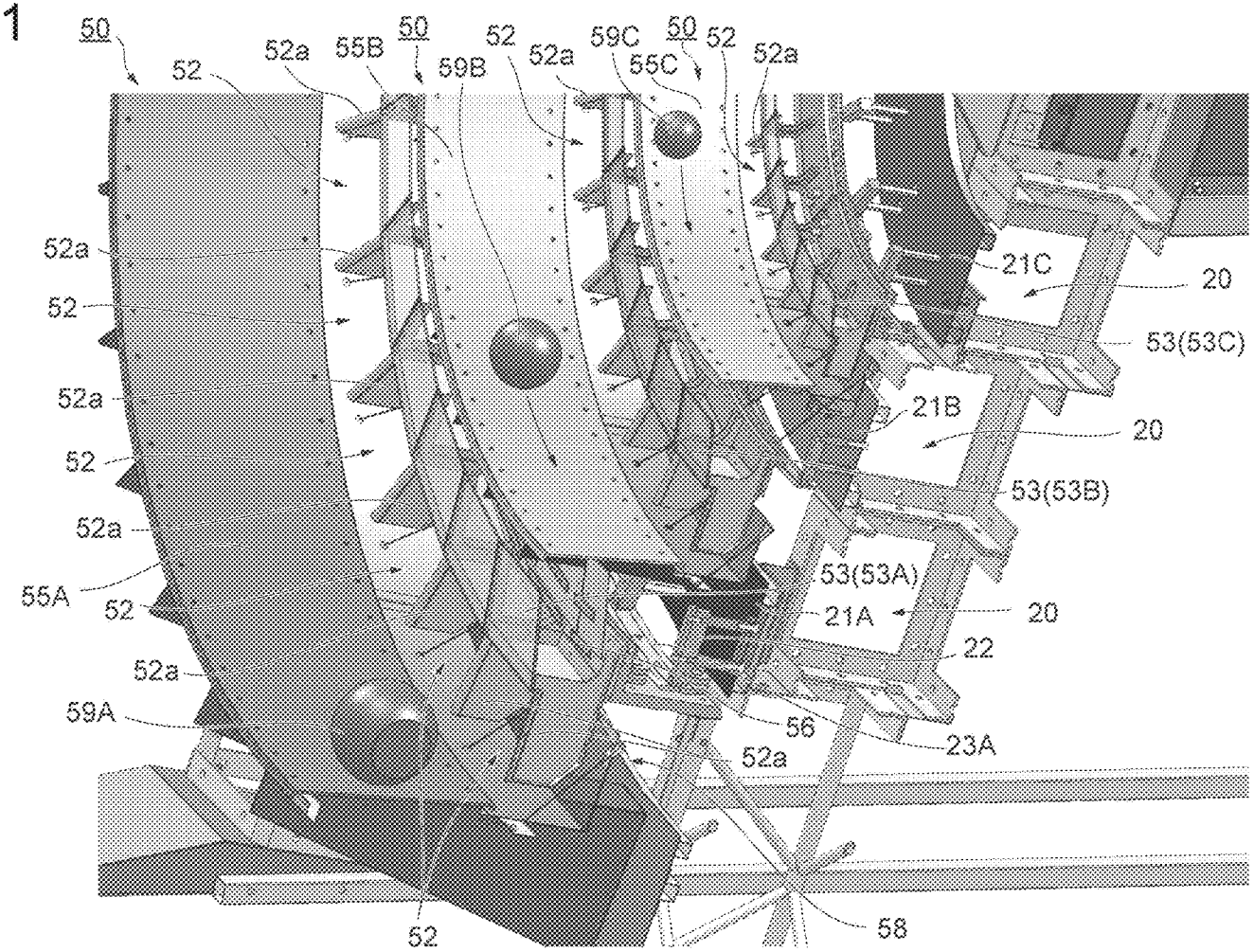
FIG. 11 is a diagram illustrating a detailed configuration around a ball rail, where a part of FIG. 9 is enlarged.

The large roulette body (large wheel) 51A, the middle roulette body (middle wheel) 51B, and the small roulette body (small wheel) 51C are formed of roulette constituent members 50, respectively. The large roulette body 51A, the middle roulette body 51B, and the small roulette body 51C are different in the size or the attachment position, but the roulette constituent members 50 in the respective roulette bodies (wheels) have the same basic configuration. The roulette constituent members 50 will be first described below. However, in the below description of the roulette constituent members 50, the roulette constituent members which are common to the large, middle, and small roulette bodies and which do not need to be distinguished from each other will be described without adding branch numbers such as A, B, and C, and the roulette constituent members will be described with the branch numbers such as A, B, and C appropriately added thereto so as to distinguish the large, middle, and small roulette bodies when distinction of the large, middle, and small roulette bodies is preferable in the drawings (see FIG. 11 and the like).

The roulette constituent members 50 include a roulette body 51, ball pockets 52, ball sensors 58 (see FIG. 11), number display sections 53, ball rotation-directing illuminations 54 (see FIG. 7), a ball rail 55, and LEDs 56.

The roulette body 51 is formed of a rotating annular member. The roulette body 51 in this embodiment is formed of a wheel-like member attached to the front surface side of the rotating member 30. The ball pockets 52 and the number display sections 53 are formed in the roulette body 51 (see FIG. 11 and the like).

The ball pockets 52 are formed by plural spaces formed in the roulette body 51 so that a ball 59 released from a ball release device 60 falls (enters) thereinto. In the roulette lottery apparatus 1 according to this embodiment, each ball pocket 52 is formed by a space defined by partitioning blades 52*a*. A winning number of the roulette is determined in advance for each ball pocket 52, and the winning number is determined depending on the ball pocket 52 into which the ball 59 falls.

The partitioning blades 52*a* are disposed on the outer circumference of the roulette body 51 so as to rotate along with the roulette body 51. The number of partitioning blades 52*a* is equal to the number of ball pockets 52. The partitioning blades 52*a* are configured to have the same shape, size, and installation interval and to have the same probability (in other words, lottery probability of a winning number) that the ball 59 falls into the respective ball pockets 52.

The ball sensor 58 is a sensor for detecting into what ball pocket 52 the ball 59 falls. The specific number and shape of the ball sensors 58 are not particularly limited. For example, in this embodiment, an optical sensor is disposed for each ball pocket 52 and it can be detected into what ball pocket 52 the ball 59 falls depending on which ball sensor detects the ball 59 (see FIG. 11).

The number display section 53 is a member (numeral board) for displaying the winning number in each roulette body. The specific configuration of the number display section 53 is not particularly limited, and the number display section 53 in this embodiment is formed on the inner circumference side of the corresponding ball pocket 52 in imitation of an actual roulette lottery apparatus and is formed of a light-transmitting member so as to look like shining. More specifically, spectators such as players feel as if the number display section shines by using light of the LEDs 56 disposed on the rear surface side of the number display section 53.

The LED 56 is a light source irradiating the number display section 53 with light from the rear surface side and making a predetermined number look like shining. The LEDs 56 may be disposed in the rotating member 30 so as to rotate along with the number display sections 53, but are disposed in the fixing member 20 instead of the rotating member 30 in this embodiment. In this way, when the LEDs 56 are configured not to rotate, the wirings of the LEDs 56 do not need to rotate and thus conduction members such as a rotor or a brush are unnecessary. Accordingly, the wirings or configurations are simplified in comparison with a case where the LEDs rotate. As a result, it is suitable from the viewpoint of durability or an extension in lifetime.

In this embodiment, the LEDs 56 are arranged on an LED board 112. The LED board 112 is supported by support legs 114 disposed on an LED base 113 (see FIGS. 29 to 31 or the like). The LED base 113 is disposed to be parallel to the number display sections 53 and is fixed to the wheel rail base 21 by support legs 115 (see FIG. 29). The LED board 112 is also disposed to be parallel to the number display sections 53.

The LED board 112, support legs 114, the LED base 113, and the support legs 115 are disposed so as not to interfere with the rotating member 30 that rotationally moves. The LED board 112 is provided with connectors 116 for wiring the LEDs 56 (see FIG. 29 or the like).

The LEDs 56 are arranged on the rear surface side of the rotating member 30 so as to circulate in a band shape. The lighting of the LEDs 56 is controlled by the control unit 80. For example, when the LEDs 56 are turned on in synchronization with the numbers of the number display sections 53 rotating along with the roulette body 51, only one number of the number display sections 53 can be made to look like shining. In the roulette lottery apparatus 1 according to this embodiment, only the number (winning number) corresponding to the ball pocket 52 into which the ball 59 falls is made to look like shining. At this time, when the LEDs 56 are controlled so as to sequentially flicker and to track the rotating number, an impression as if a light source is present behind the winning number and rotates along with the number display section 53 can be given to spectators (see the description of "Rotating Apparatus Having Light-emitting Device Attached thereto" to be described later).

The ball rail 55 is a guide of an annular shape or a conic shape (taper shape) opened to the near side (front side) that guides the ball 59 released from the corresponding ball release device 60. The ball rail 55 according to this embodiment is formed of a tubular member having a slightly larger diameter than that of the corresponding roulette body 51 and fixed to the fixing member 20 (see FIGS. 8 and 9). The ball 59 released from the ball release device 60 swings to the right and left sides (pendular movement) along the surface of the ball rail 55 while slowly decreasing the amplitude thereof. A drop-preventing guard 57 for preventing the ball 59 from being dropped to the front side (near side) of the ball rail 55 may be provided (see FIG. 6 and the like). The sizes (diameters) of the ball rails 55 have different curvatures depending on the sizes of the roulette bodies 51A, 51B, and 51C (see FIG. 9 and the like). Accordingly, the period of pendular movement of the ball 59 differs depending on the large, middle, and small roulette bodies 51A to 51C. Particularly, in the large roulette body 51A, since the ball 59A is large and it looks like moving relatively slowly in a pendular motion, a lottery looking profound by as much can be directed and is suitable for a final lottery out of the three roulette bodies 51A, 51B, and 51C.

Figure 9:
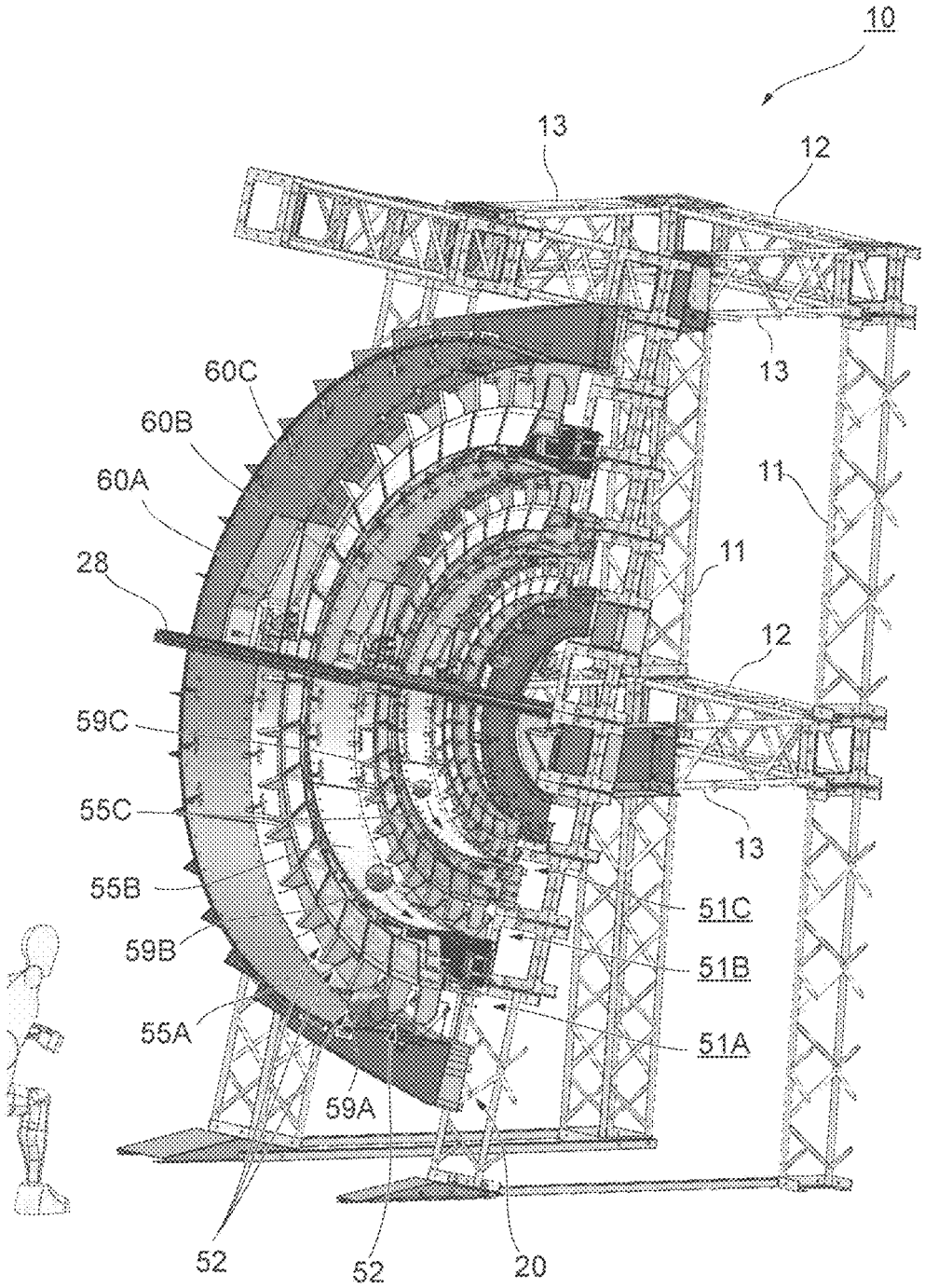
FIG. 9 is a perspective view illustrating a cross-section of the internal structure of the roulette lottery apparatus.

The ball rails 55 are arranged in a state where it is tilted to the rear surface side of the roulette lottery apparatus 1 similarly to the fixing members 20 (see FIG. 9 and the like). Accordingly, each ball rail 55 normally applies a force toward the ball pockets 52 to the ball 59 swinging on the ball rail 55 and guides the ball 59 having a slowly-decreasing amplitude to fall into any ball pocket 52. In this embodiment, since the ball rail 55 has a conic shape (taper shape) opened to the near side (front side) and the tilt angle of the part for guiding the ball 59 to the ball pockets 52 can be changed, it is possible to adjust the time until the ball 59 is guided and falls into the ball pockets 52.

Ball Release Device 60

Figure 13:
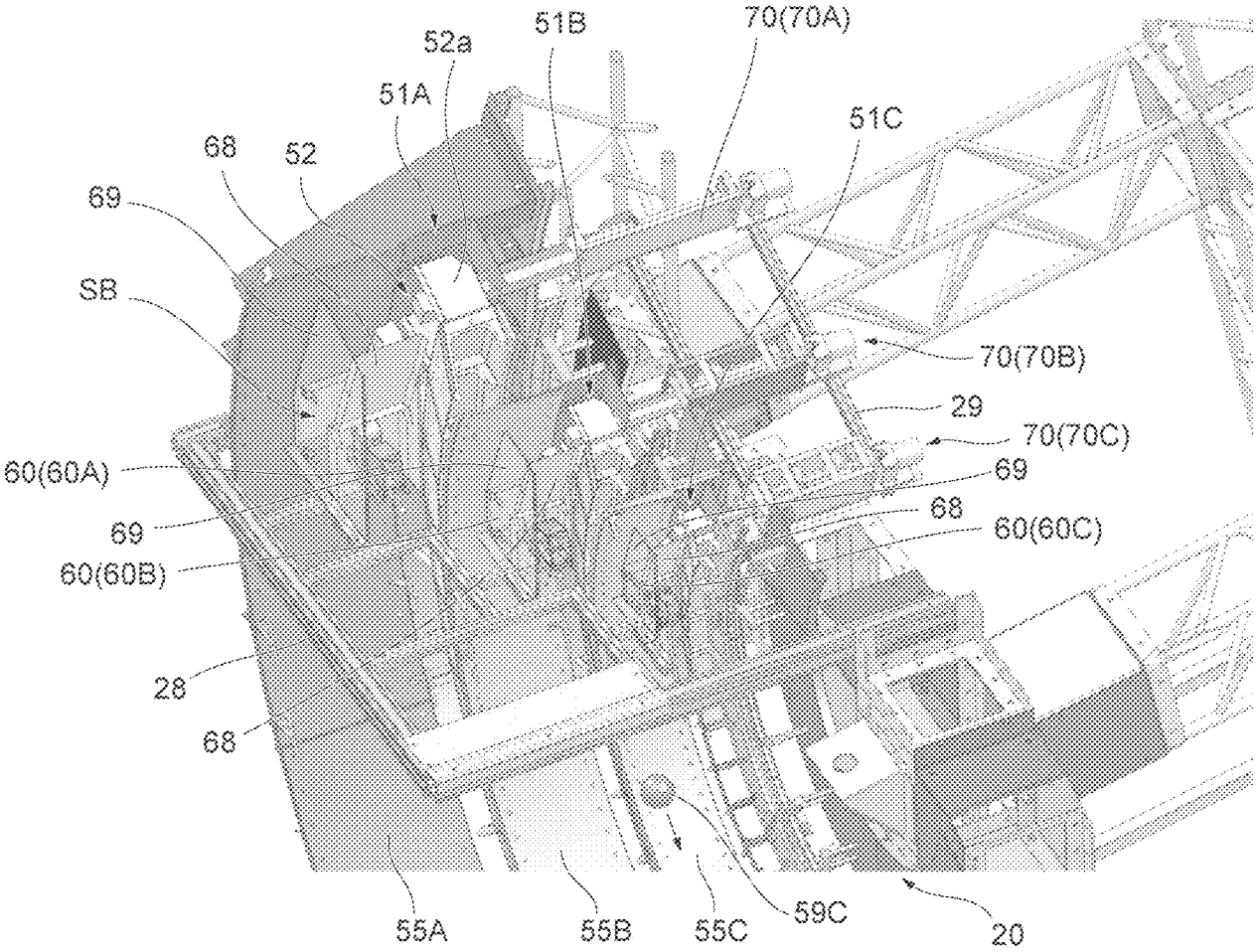
FIG. 13 is a perspective view illustrating a ball release device and a ball reset device, where the roulette lottery apparatus is partially cut.

The ball release device 60 is a device that releases and shoots the ball 59 in a standby state at the time of carrying out a roulette lottery. The ball release device 60 according to this embodiment is fixed to the fixing member 20 via a ball release device-fixing frame 28 at a position suitable for releasing the held ball 59 to the ball rail 55, for example, about a 9:00 position (standby position which is denoted by reference sign SB in FIG. 13) when facing the roulette bodies 51 (see FIGS. 7, 9, and 13 and the like). A configuration example of the ball release device 60 will be described below.

Figure 24:
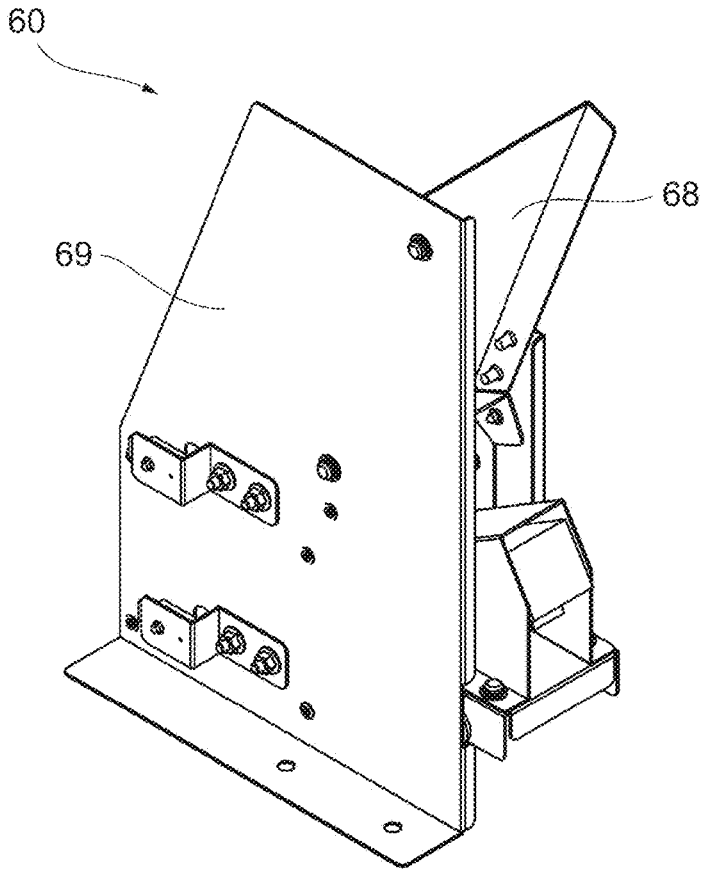
FIG. 24 is a perspective view illustrating the ball release device.
Figure 25:
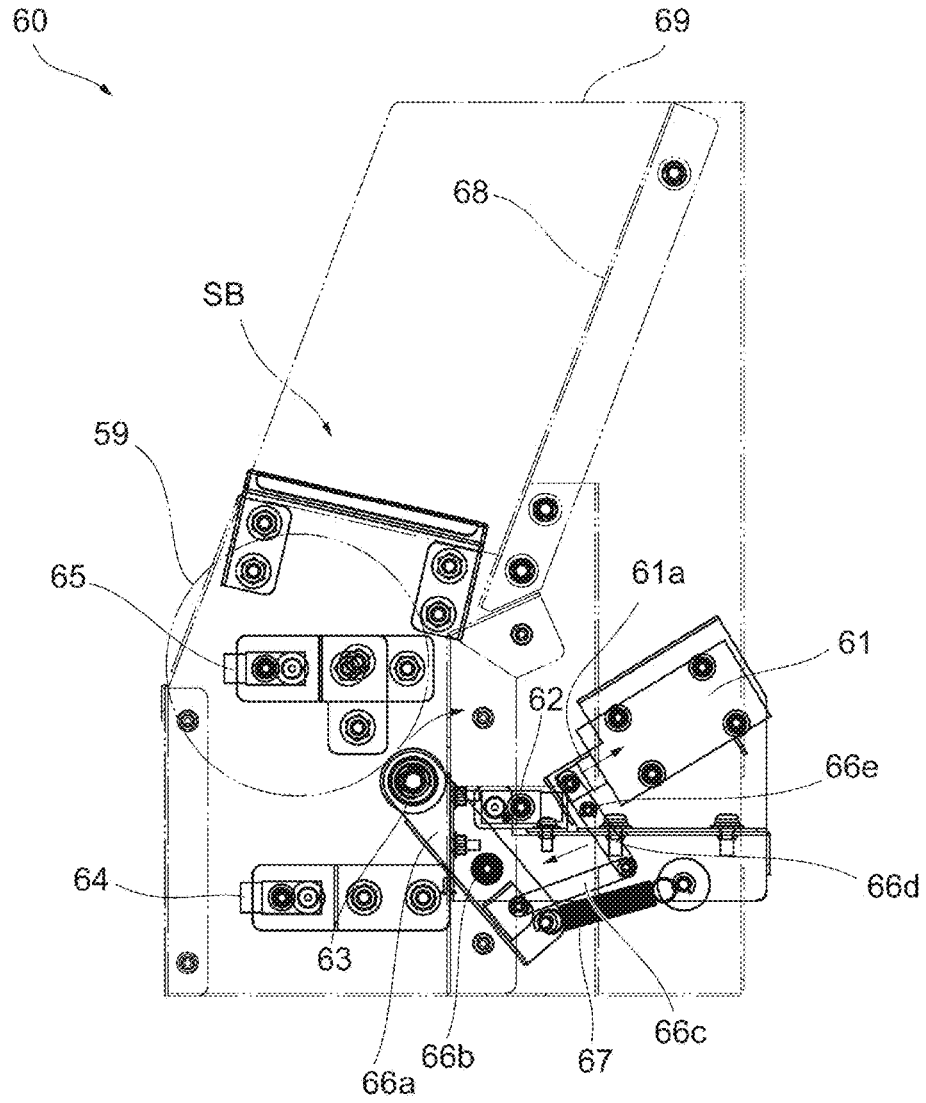
FIG. 25 is a diagram illustrating an inner configuration of the ball release device.

The ball release device 60 according to this embodiment comprises members such as a solenoid 61, a solenoid sensor 62, a roller 63, a release sensor 64, a setting sensor 65, a roller support lever 66*a*, a link 66*c*, a transmission lever 66*d*, and a coil spring 67 (see FIG. 25 and the like). These members are attached to an attachment plate 68 in which two plate-like members are combined with an angle and a cover plate 69 disposed on the front side of the roulette lottery apparatus 1 when viewed from the attachment plate 68 (see FIGS. 13 and 24 and the like). A passing space of the ball 59 is formed in the attachment plate 68 and the cover plate 69 (see FIG. 25 and the like).

The roller 63 regulating the ball 59 is attached to the tip of the roller support lever 66*a* which is rotatable about a pivot 66*b*. The roller support lever 66*a* is in a state (standby state) in which the base end thereof is drawn and biased with the coil spring 67 and the roller 63 protrudes into the passing space of the ball 59 (see FIG. 25). The roller support lever 66*a* is connected to a plunger 61*a* of the solenoid 61 via the link 66*c* and the transmission lever 66*d*. When the solenoid 61 is supplied with power and the plunger 61*a* is drawn, the transmission lever 66*d* swings in the clockwise direction in FIG. 25 about the pivot 66*e* and movement thereof is transmitted to the roller support lever 66*a* via the link 66*c*. The roller support lever 66*a* to which movement is transmitted swings in the clockwise direction in FIG. 25 about the pivot 66*b* and causes the roller 63 to retreat from the ball passing space. When the roller 63 retreats, the ball 59 in the standby state is released and falls.

The solenoid sensor 62 is a sensor for detecting the roller 63 or the roller support lever 66*a* retreating from the ball passing space and checks that the roller 63 makes predetermined movement. The setting sensor 65 checks presence of the ball 59 at the standby position. The release sensor 64 is disposed in the vicinity of a ball-falling hole in the ball release device 60 and detects that the ball 59 is released and falls.

Figure 6:
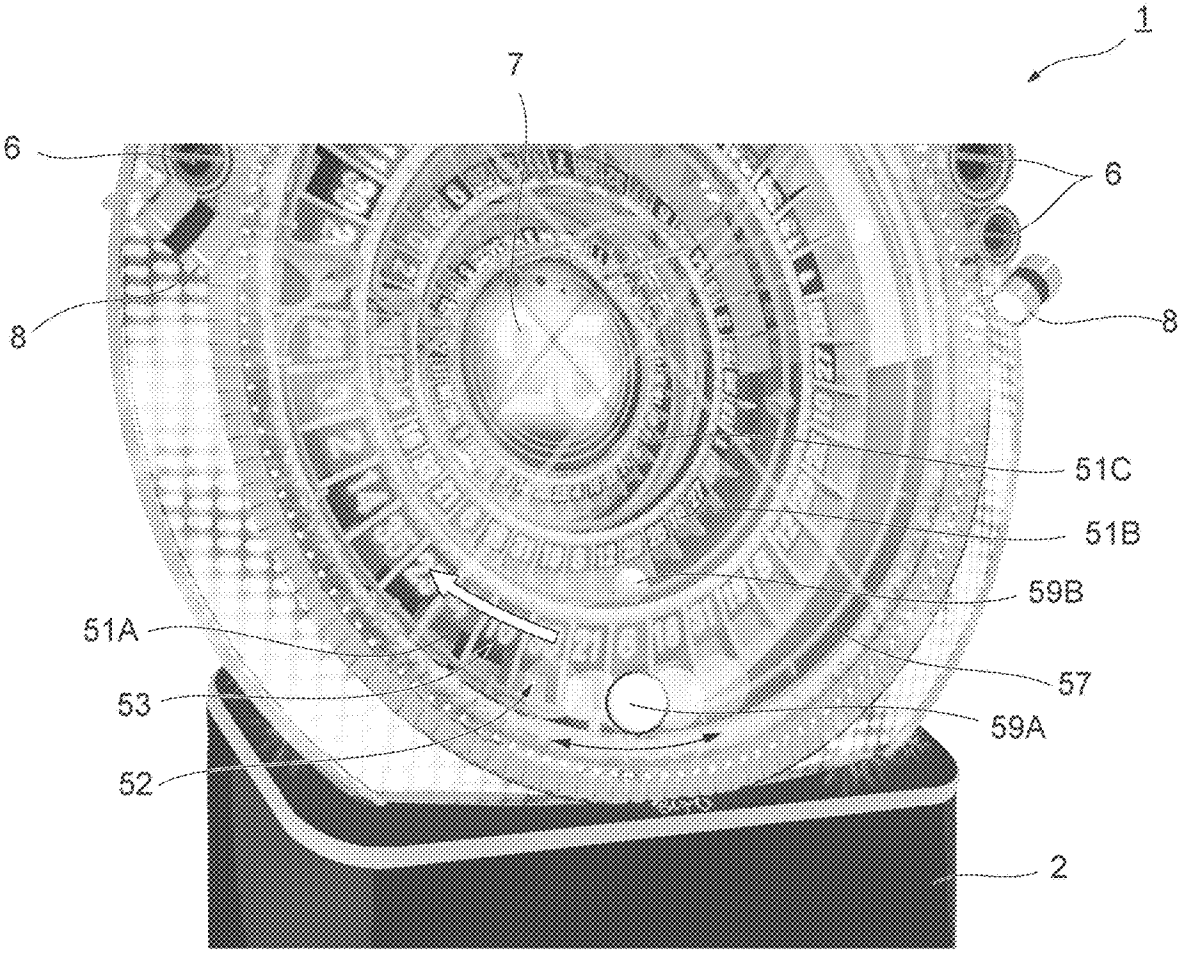
FIG. 6 is a diagram illustrating a roulette lottery apparatus at the time of carrying out a lottery when viewed from the diagonal front side.

The ball 59 released from the ball release device 60 swings to the right and left sides along the surface of the ball rail 55, slowly decreases the amplitude, falls down from the ball rail 55, and enters into any ball pocket 52 of the roulette body 51 (see FIG. 6 and the like). The movement of the ball 59 at this time varies depending on various factors (such as the size and the weight of the ball 59, the speed at the time of release, the size of the roulette body 51, the size of each ball pocket 52, the size or shape of the partitioning blades 52*a*, and the tilt angle of the rotation center line Z of the roulette body 51 to the rear side with respect to the horizontal plane), and the ball may smoothly enter into any ball pocket 52 or may bound from the partitioning blades 52*a* and swing for a long time. The movement of the ball 59 is greatly different from that in the conventional roulette game system and can give a fresh or interesting impression to spectators.

Thereafter (for example, after the balls 59 enter into the ball pockets 52 in all the three roulette bodies 51A to 51C and the winning numbers are determined), in order to recover the balls 59 falling into the ball pockets 52, the roulette bodies 51 rotate in the clockwise direction in the drawing to move the balls 59 to the positions (recovery positions) immediately before the ball reset devices 70.

Ball Reset Device 70

Figure 26:
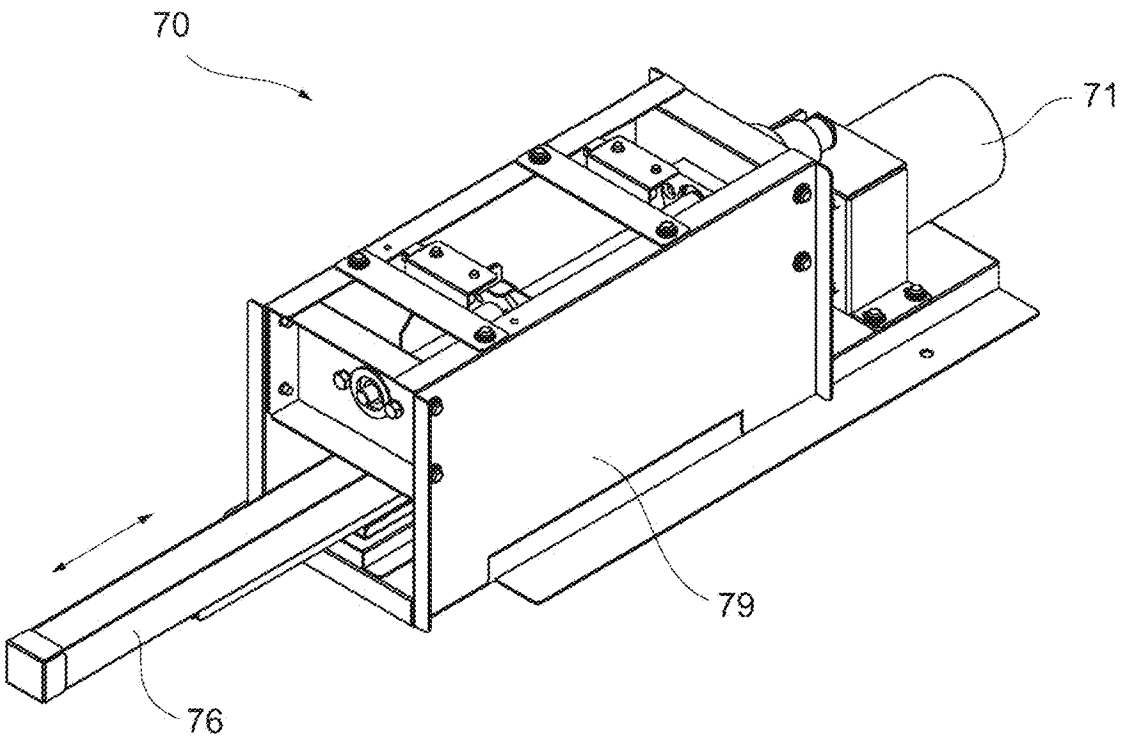
FIG. 26 is a perspective view illustrating the ball reset device.

The ball reset device 70 is a device that extrudes the ball 59 moving to the recovery position to the front side of the roulette lottery apparatus 1 and moves and resets (returns to the standby state) the ball to the standby position. The ball reset device 70 according to this embodiment is fixed to the fixing member 20 via a ball reset device-fixing frame 29 at a position suitable for extruding the ball 59 to the ball release device 60, for example, a position on the rear side of the ball release device 60 (see FIG. 13). A configuration example of the ball reset device 70 will be described below (see FIGS. 26 and 27).

Figure 27:
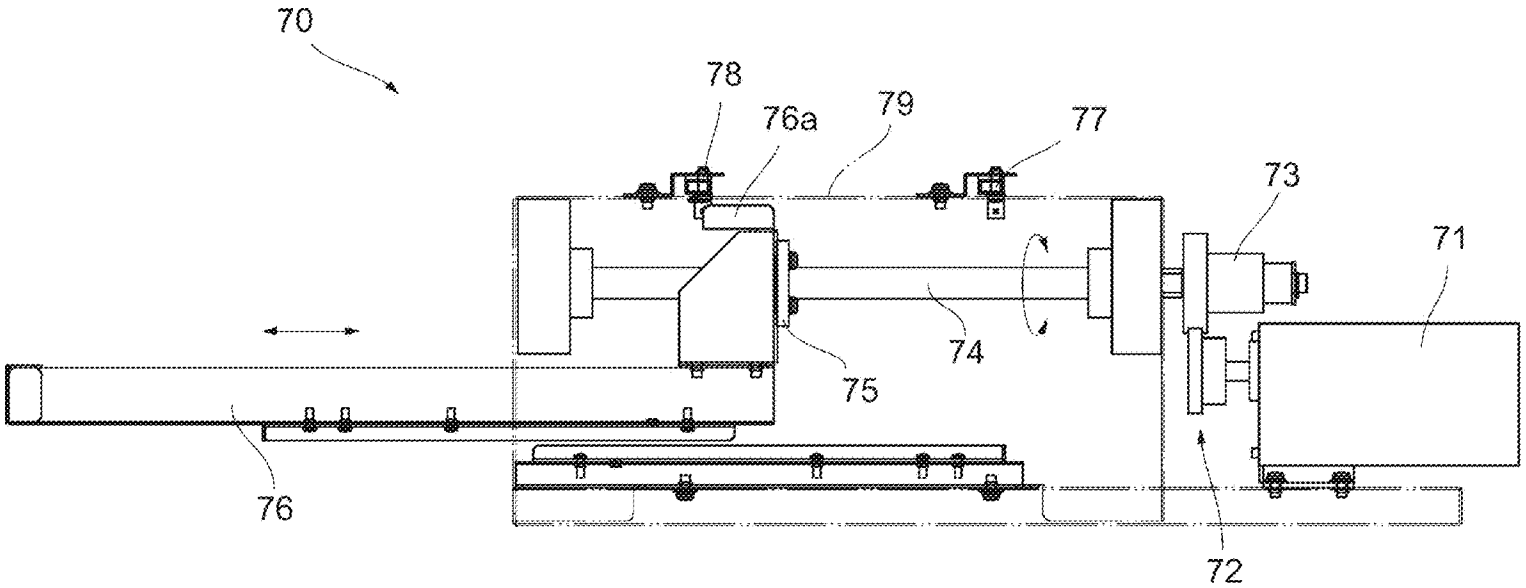
FIG. 27 is a diagram illustrating an inner configuration of the ball reset device.

The ball reset device 70 according to this embodiment comprises members such as a ball reset motor 71, a gear train 72, a torque limiter 73, a ball screw 74, a change nut 75, a ball extruding rod 76, a sensor dog 76*a*, a home sensor 77, and a limit sensor 78 (see FIG. 27). These members are attached to a channel-like attachment frame member 79.

The ball reset motor 71 transmits a drive force via the gear train 72 to rotate the ball screw 74. The ball screw 74 is rotatably supported by the attachment frame member 79 and moves the ball extruding rod 76 attached to the change nut 75 on the ball screw 74 in the front-and-rear direction (to the front side or the rear side of the roulette lottery apparatus 1).

The ball extruding rod 76 moves forward to the front side from a home position (initial position) to extrude the ball 59 to the ball release device 60 and then moves backward to the rear side to return to the home position. The forward and backward movement of the ball extruding rod 76 is determined depending on the rotation direction (forward rotation or backward rotation) of the ball reset motor 71. The stop position in forward movement and backward movement of the ball extruding rod 76 is detected by causing the sensor dog 76*a* attached to the ball extruding rod 76 to pass through any one of the home sensor 77 and the limit sensor 78 disposed in the attachment frame member 79.

The home sensor 77 detects that the ball extruding rod 76 moves backward to the home position. The limit sensor 78 detects that the ball extruding rod 76 moves forward to a predetermined ball extrusion position (limit position). The torque limiter 73 is attached to the shaft of the ball screw 74 and protects the ball extruding rod 76 and the ball reset motor 71 when problems such as overrun or overload occur.

A series of operations of the ball reset device 70 will be simply arranged as follows. First, it is checked whether the ball extruding rod 76 is located at the home position by checking the home sensor 77. Then, the ball reset motor 71 is rotated to cause the ball extruding rod 76 to move forward. When the limit sensor 78 detects the sensor dog 76*a*, it is determined that the ball extruding rod 76 moves forward to the limit position, and the ball reset motor 71 is stopped. After a predetermined time passes, the ball reset motor 71 is reversely rotated to cause the ball extruding rod 76 to move backward. When the home sensor 77 detects the sensor dog 76*a*, it is determined that the ball extruding rod 76 returns to the home position, and the ball reset motor 71 is stopped.

Control Unit 80

The control unit 80 comprises a CPU and a memory (a ROM and a RAM), and embodies various functions to control the game system 100 as a whole by executing a game program 91 in the storage unit 90. The functions embodied by the control unit 80 comprises a game control unit 81, a drive system control unit 82, a roulette body control unit 83, a ball release control unit 84, a ball reset control unit 85, a display control unit 86, a sound control unit 87, and an illumination control unit 88 (see FIG. 2).

Figure 2:
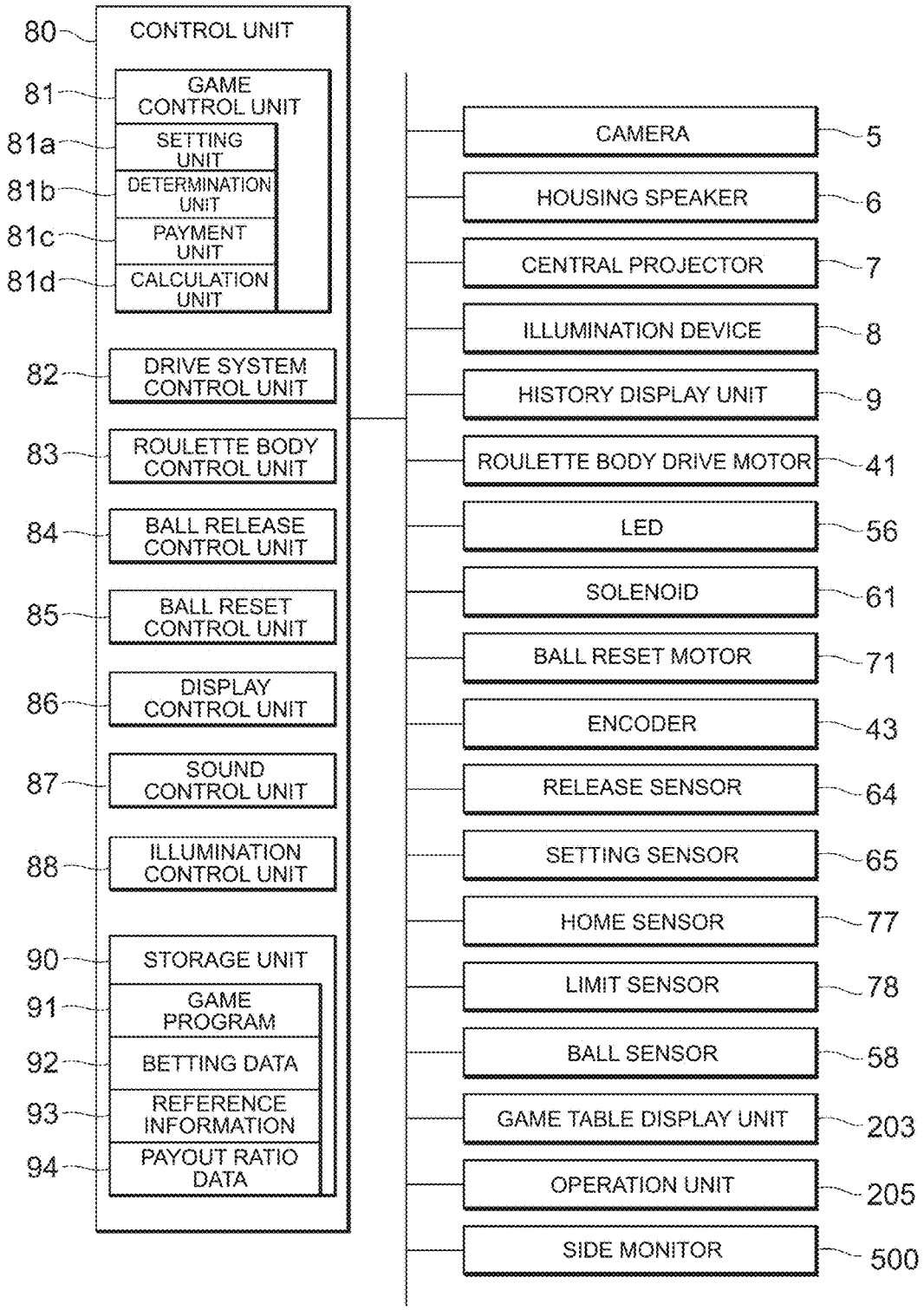
FIG. 2 is a block diagram illustrating a configuration example of the roulette game system.

The control unit 80 controls various elements of the game system 100, for example, the camera 5, the housing speakers 6, the central projector 7, the illumination devices 8, the history display unit 9, the roulette body drive motors 41, the LEDs 56, the solenoids 61, the ball reset motors 71, the game table display units 203, the operation units 205, and the side monitors 500 (see FIG. 2). For example, operation signals from the operation unit 205 for allowing a player to perform a betting operation in a game table displayed on the game table display unit 203 or detection signals from the encoders 43, the release sensors 64, the setting sensors 65, the home sensors 77, the limit sensors 78, and the ball sensors 58, and the like are transmitted to the control unit 80. A game program 91, betting data 92, reference information 93, payout ratio data 94, and the like are stored in the storage unit 90 (see FIG. 2).

The game control unit 81 controls the roulette game by executing the game program 91 in the storage unit 90. The game control unit 81 stores the betting data 92 based on the progress of the game or the reference information 93 representing the histories of the past game results and accumulates the payout ratio data 94.

The game control unit 81 also serves as a setting unit 81*a*, a determination unit 81*b*, a payment unit 81*c*, and a calculation unit 81*d* for carrying out the roulette game. The setting unit 81*a* sets various values of the roulette game with the progress of the game. The determination unit 81*b* determines a winning number (numeral corresponding to the ball pocket 52 into which the ball 59 fall) on the basis of the detection signal from the ball sensor 58. The payment unit 81*c* performs payment for predicted settings when the determination unit 81*b* determines that the prediction wins. The payment unit 81*c* performs a process of paying the number of chips corresponding to the betting. The calculation unit

81*d* performs a predetermined calculation (for example, a calculation of a payout ratio or probabilities of the respective winning numbers) on the basis of the determined winning number and stores the calculated payout ratio as the payout ratio data 94 (see FIG. 2).

The drive system control unit 82 controls the operations (the rotation, the rotation speed, and the stop) of the roulette bodies 51 through the use of the roulette body drive motor 41. The ball release control unit 84 controls the ball release operation in the ball release device 60. The ball reset control unit 85 controls the ball reset operation in the ball reset device 70. The display control unit 86 controls the display operations of the game table display unit 203, the central projector 7, and the history display unit 9 under the control of the control unit 80. The sound control unit 87 controls the outputs of voices or various sound effects from the housing speakers 6 and the like with the progress of the game. The illumination control unit 88 controls illumination in the illumination devices 8 and the like.

The storage unit 90 is embodied by a hard disk drive or the like and stores various programs or data. The data stored in the storage unit 90 comprises the betting data 92 indicating betting states set by the setting unit 81*a*, the reference information 93 (history information of a winning number or an appearance ratio of the numbers in past games) as a betting reference which is provided to players in a betting-enabling time, and the payout ratio data 94 indicating a current payout ratio calculated by the calculation unit 81*d*.

Rotating Apparatus Having Light-Emitting Device Attached Thereto

Figure 33:
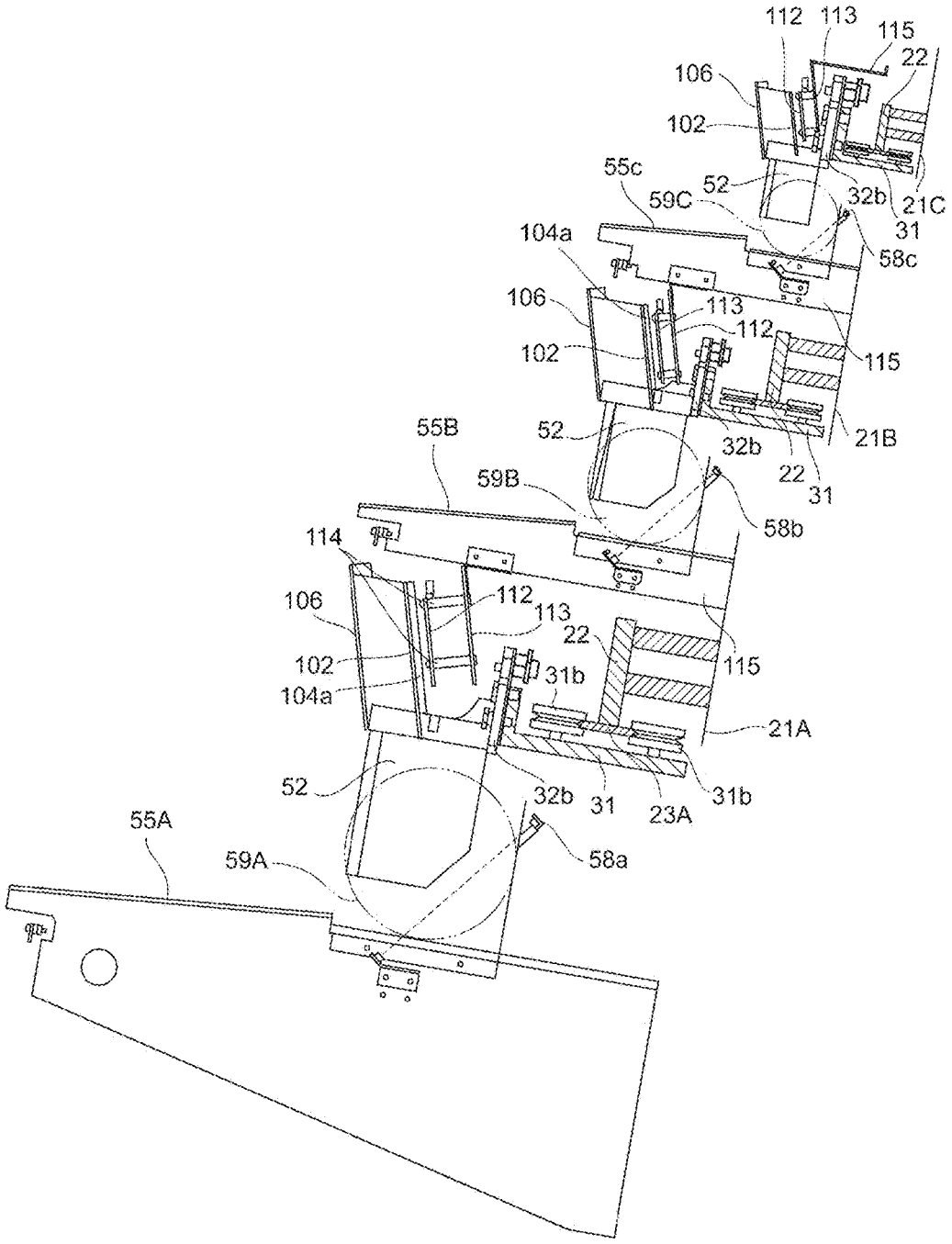
FIG. 33 is a diagram illustrating the structure illustrated in FIG. 32 when viewed from the cross-section side.

The rotating apparatus 600 having a light-emitting device 700 attached thereto in the roulette lottery apparatus 1 according to this embodiment will be described below (see FIGS. 29 to 33). In FIG. 33, the ball rails 55 corresponding to the large, middle, and small roulette bodies 51A, 51B, and 51C are referenced by reference signs 55A, 55B, and 55C and the wheel rail bases 21 corresponding thereto are referenced by reference signs 21A, 21B, and 21C.

The light-emitting device 700 is a device for causing only a predetermined number display section 53 to look like shining uniformly in synchronization with the progress of the roulette game and comprises the LEDs 56 as a light source, power supply cords (not illustrated) of the LEDs 56, and a control unit 80 that controls the turning-on and turning-off of the LEDs 56. The function of the control unit 80 that controls the turning-on and the turning-off of the LEDs 56 is embodied, for example, by the roulette body control unit 83 or the illumination control unit 88.

Figure 29:
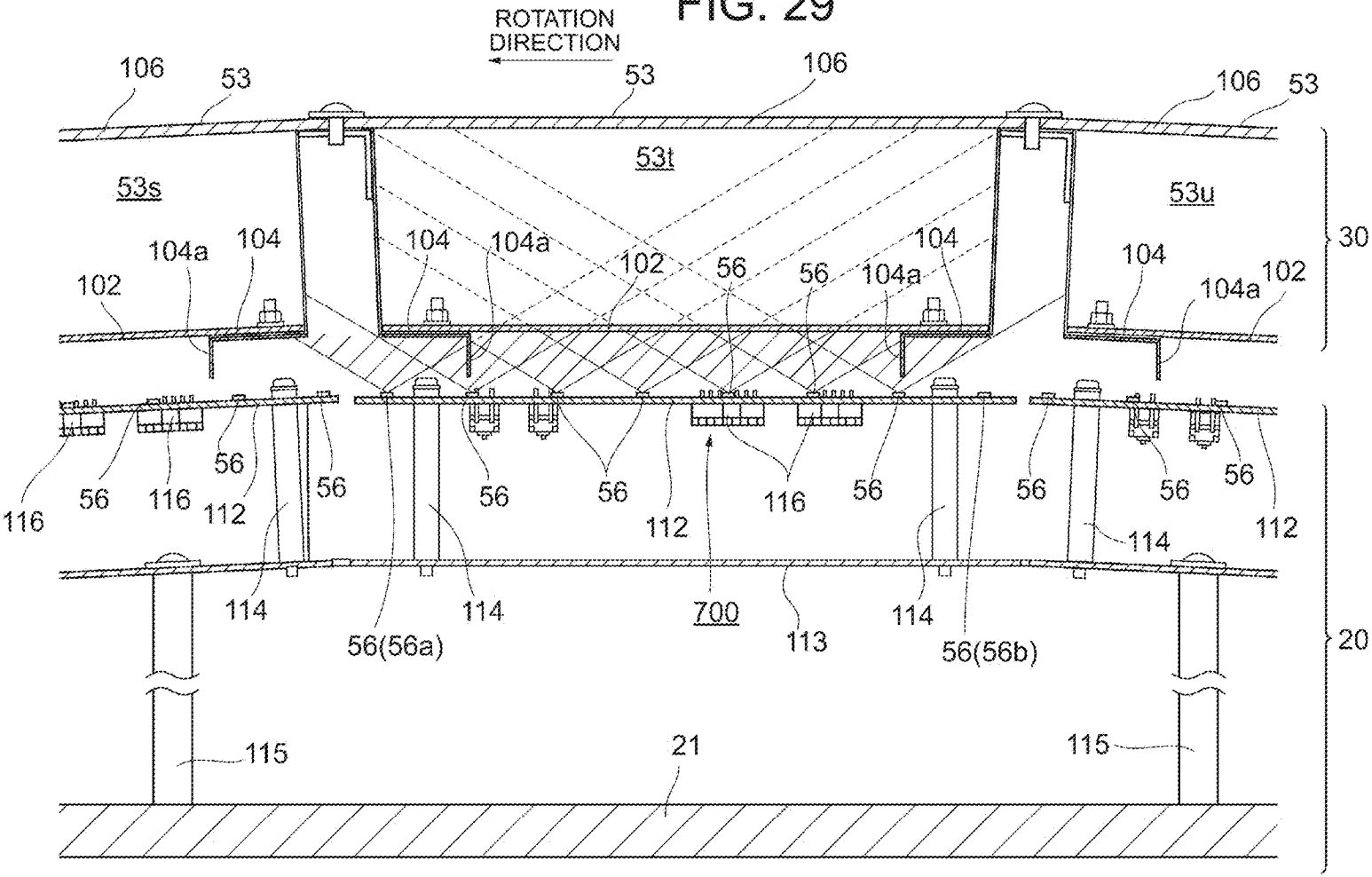
FIG. 29 is a diagram illustrating a cross-section parallel to the tangential direction of the rotation direction in the structure of number display sections (light-irradiated areas), LEDs (light source), and the like in an embodiment of a rotating apparatus having a light-emitting device attached thereto according to an embodiment.

Light-blocking bodies 104 are further formed in the rotating apparatus 600 (see FIG. 29 or the like). Each light-blocking body 104 prevents light applied to a specific light-irradiated area (which is referenced by reference sign 53*t* in FIG. 29 or the like for the distinction from other number display sections) as a light irradiation target out of plural number display sections 53 from leaking into other light-irradiated areas (which are referenced by reference signs 53*s* and 53*u* in FIG. 29 or the like for the distinction from the specific light-irradiated area 53*t*) adjacent to the specific light-irradiated area 53*t*. The light-blocking bodies 104 are formed between the neighboring light-irradiated areas.

The specific structure of each light-blocking body 104 is not particularly limited, but for example, the light-blocking body 104 in this embodiment is formed in a shape extending in the circumferential direction of the rotating member 30 (comprising the annular rotating body 32) (see FIG. 29 or the like). When the width (the length in the rotation direction of the annular rotating body 32) of the light-blocking body 104 is large, the timing of turning on or turning off the LEDs 56 has a width and is easily controlled.

A part of the light-blocking body 104 in this embodiment is formed to form a light-blocking portion 104*a* having a shape protruding from the rotating member 30 (comprising the annular rotating body 32) to the LEDs 56 (see FIG. 29 or the like). The light-blocking portion 104*a* having a shape protruding to the LEDs 56 in this way serves as a cap (awning) and prevents light from leaking into other light-irradiated areas 53*s* and 53*u*.

The light-blocking body 104 is formed of a material not transmitting light. In that the light-blocking body 104 rotates along with the annular rotating body 32, the material preferably has a small weight and a degree of strength enough not to cause deformation. For example, the light-blocking body 104 in this embodiment is formed of a soft urethane material but may be formed of other materials.

In the rotating apparatus 600, a sheet-like light-diffusing member 102 that diffuses light emitted from the LED 56 into the light-irradiated area 53*t* is disposed in parallel to the LED board 112 with a predetermined gap interposed therebetween (see FIG. 29 or the like). The number display section 53 is disposed in parallel to the light-diffusing member 102 with the light-irradiated area 53*t* as a predetermined space interposed therebetween. Since light emitted from the LED 56 passes through the light-diffusing member 102 and uneven light intensity of the diffused light disappears in the light-irradiated area 53*t*, the light transmitted by the light-irradiated area 53*t* reaches the light-transmitting member 106 and the number display section 53 becomes visible with uniform brightness. Accordingly, when the numeral or the like formed in the number display section 53 to correspond to the ball pocket 52 looks like shining, the uneven light intensity disappears and the numeral or the like is more conspicuous.

The number display section 53 is formed by masking the surface of the light-transmitting member (for example, an acrylic plate) 106 except for the part of the numeral with a black or red transmissive dye. A winning number or the like in the roulette is displayed in the light-transmitting member 106. Light emitted from an LED is diffused by the light-diffusing member 102 and is then applied to the light-transmitting member 106 so as to cause the number display section 53 to look like shining.

The operation, the function, and the like of the rotating apparatus 600 having the light-emitting device 700 attached thereto will be described below (see FIG. 29 or the like).

In the roulette lottery apparatus 1 according to this embodiment, when the ball 59 is dropped into a ball pocket 52 and a winning number is determined at the time of lottery using the roulette body 51, a directing operation of displaying the winning number so as to be conspicuous to viewers such as players by irradiating only the light-irradiated area 53*t* corresponding to the specific number display section 53 corresponding to the winning number with light to cause the numeral portion to look like shining and rotating the roulette body 51 by about one turn is performed. The degree of rotation of the roulette body 51 is detected by the encoder 43 and is controlled by the roulette body control unit 83. At this time, the control unit 80 controls the turning-on and turning-off of the LEDs 56 so as to follow the rotation of the specific number display section 53 as a light irradiation target and performs a synchronization operation so as to irradiate only the specific number display section 53 with light from the rear side.

In this way, when the LEDs 56 are turned on or off in synchronization with the rotational movement of the specific number display section 53, the control unit 80 in this embodiment turns on or off the LED 56 overlapping with the rotating light-blocking body 104. Description will be given below in conjunction with a specific example. When the light-irradiated area 53*t* corresponding to a specific number display section 53 on the roulette body 51 moves to the left side in the drawing, an LED to be newly turned on (which is referenced by reference sign 56*a* in FIG. 29) is turned on at the timing at which the light-blocking body 104 overlaps with the LED 56*a* (where the LED 56*a* is located between the light-blocking portion 104*a* on the light-irradiated area 53*s* side and the light-blocking portion 104*a* on the light-irradiated area 53*t* side). In this case, the light of the turned-on LED 56*a* is blocked by the light-blocking body 104 and does not leak into the light-irradiated area 53*s* corresponding to the neighboring number display section 53 (see FIG. 29). Thereafter, when the roulette body 51 rotates and the specific light-irradiated area 53*t* further moves, the light emitted from the turned-on LED 56*a* is applied to the light-irradiated area 53*t* (see FIGS. 30 and 31).

As described above, in this embodiment, an LED to be newly turned-off (which is referenced by reference sign 56*b* in FIG. 29) is turned off at the timing at which the light-blocking body 104 overlaps with the LED 56*b*. In this case, the light of the LED 56*a* until being turned off is blocked by the light-blocking body 104 and does not leak into the neighboring light-irradiated area 53*u* (see FIGS. 29 to 31).

In this way, in the rotating apparatus 600 of the roulette lottery apparatus 1 according to this embodiment, the plural LEDs 56 arranged to circulate on the rear side of the number display sections 53 are used and the turning-on and turning-off of the LEDs 56 are controlled in synchronization with the rotational movement of a specific number display section 53 as the light irradiation target. Accordingly, since the light-irradiated areas are located on the rear side of the number display sections 53 with respect to viewers such as players with a predetermined gap interposed therebetween, transmitted light of the light emitted from the LED 56 is randomly reflected by the light-diffusing member 102, the light diffused by the light-irradiated area enters the light-diffusing member 102, and the transmitted light is further randomly reflected and diffused. As a result, uniform light seems to be emitted from the surface of the number display section 53 in a surface emission manner and an impression that the number display section 53 surface-emitting light rotates together can be given.

Figure 30:
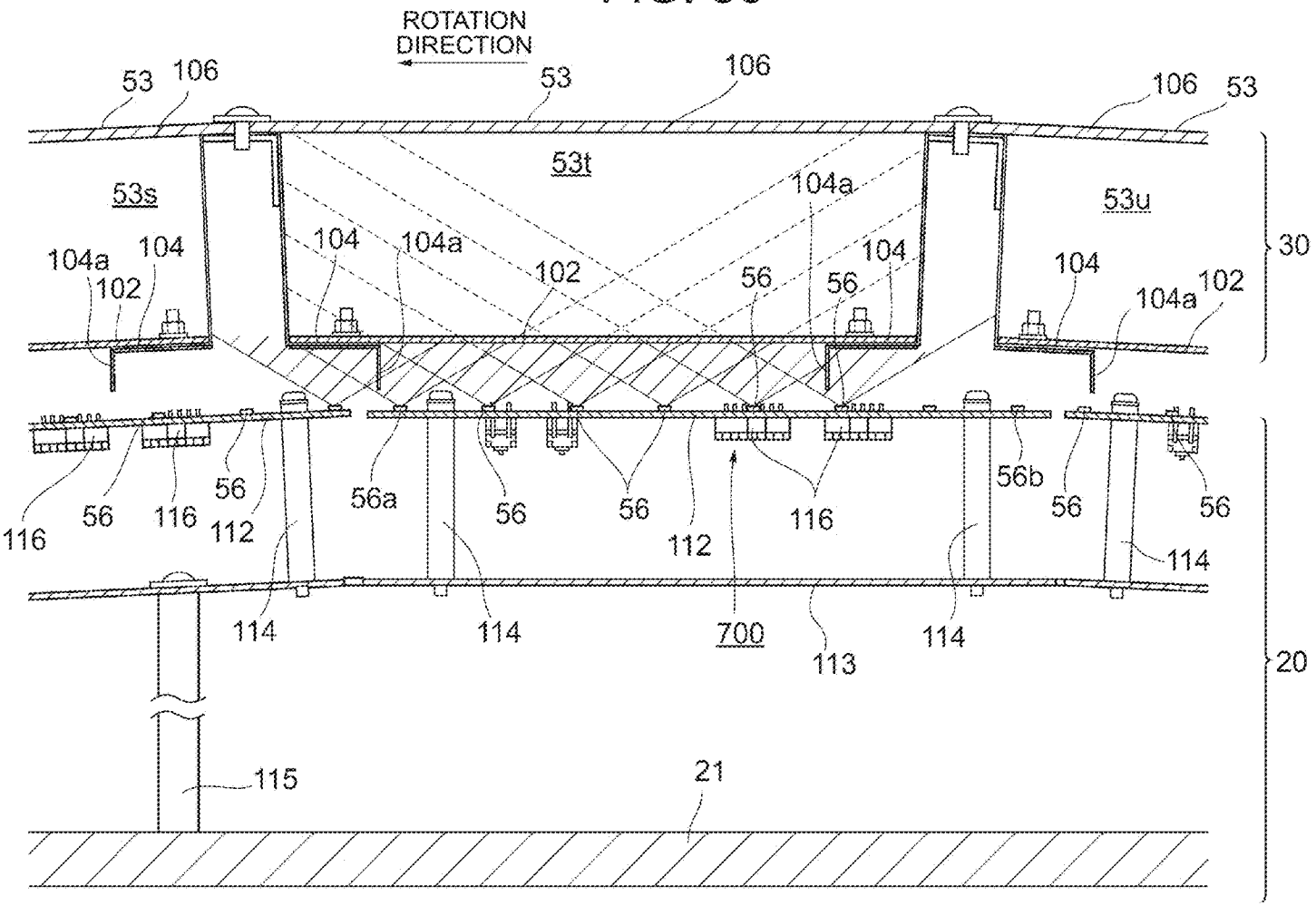
FIG. 30 is a diagram illustrating a state where the number display sections move from the state illustrated in FIG. 29 with the rotation of the rotating member.
Figure 31:
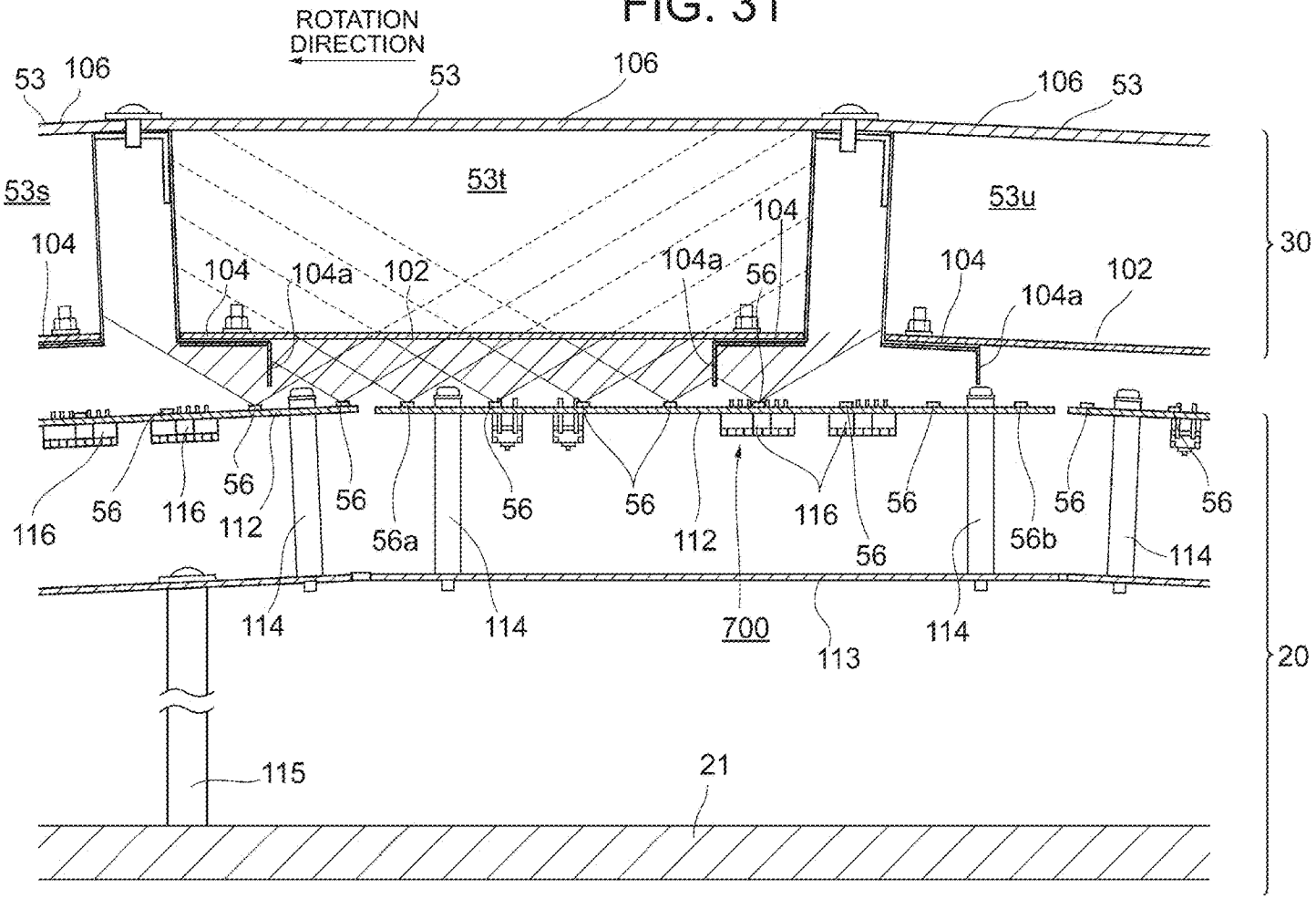
FIG. 31 is a diagram illustrating a state where the number display sections further move from the state illustrated in FIG. 30 with the rotation of the rotating member.
Figure 32:
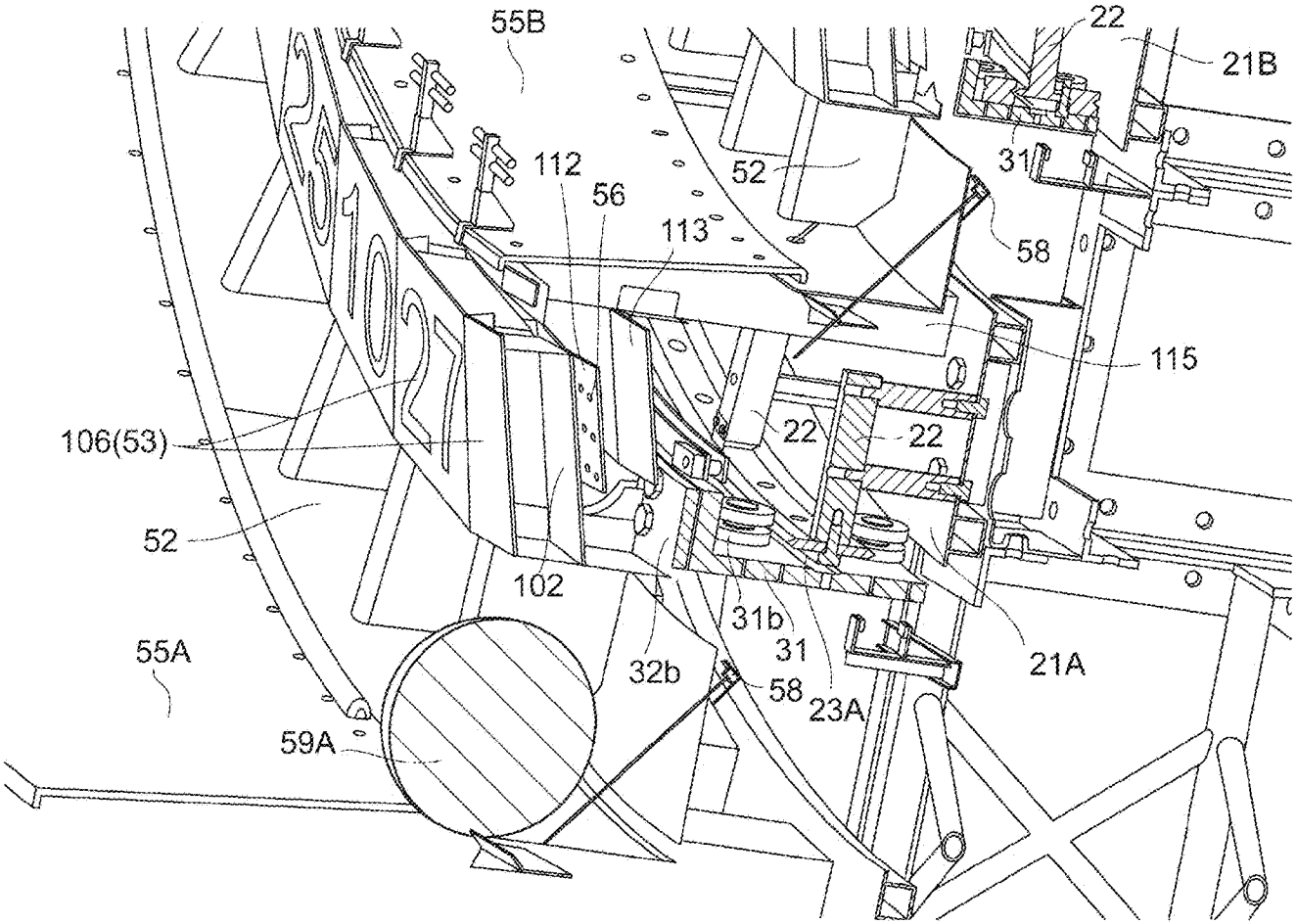
FIG. 32 is a perspective view illustrating the number display sections (light-irradiated areas), the LEDs (light source), and the like along with the structure in the cross-section.

In addition, in the rotating apparatus 600, the LEDs 56 are repeatedly turned on and off one by one (line by line when plural lines are arranged) with respect to the rotating member 30 (comprising the annular rotating body 32) that smoothly (continuously) moves rotationally, and follows the specific light-irradiated area 53*t* of the rotating member 30 while moving in a lighting range in a step-like manner (discontinuously) (see FIGS. 29 to 31). Nevertheless, in the rotating apparatus 600 according to this embodiment in which the turning-on and turning-off of the LEDs 56 is controlled by the control unit 80 and leakage of light is prevented by a physical structure such as the light-blocking body 104 as described above, light flickering does not occur when the specific light-irradiated area 53*t* is directed to look like shining, a discomfort feeling is not given to viewers, and an impression of poor quality is not given to the viewers.

In order to cause the light sources to rotate along with the rotating member, a device such as a rotational-connecting connector is necessary. However, in this embodiment, since the LEDs (light source) 56 do not rotate and are fixed, the device such as a rotational-connecting connector is not necessary. Accordingly, it is possible to prevent an increase in the number of components into being complicated and to avoid problems in reliability or durability of the connector while allowing the light source to seem to be located in the back of the number display section 53.

In the rotating member 30 (comprising the annular rotating body 32) of the rotating apparatus 600 according to this embodiment, plural number display sections 53 are equally partitioned in the circumferential direction and the number display sections 53 have the same size (width in the circumferential direction). Accordingly, when any specific light-irradiated area out of the plural number display sections 53 is selected, the LEDs 56 can be turned on and off at the same timing.

Operations of Roulette Lottery

Figure 28:
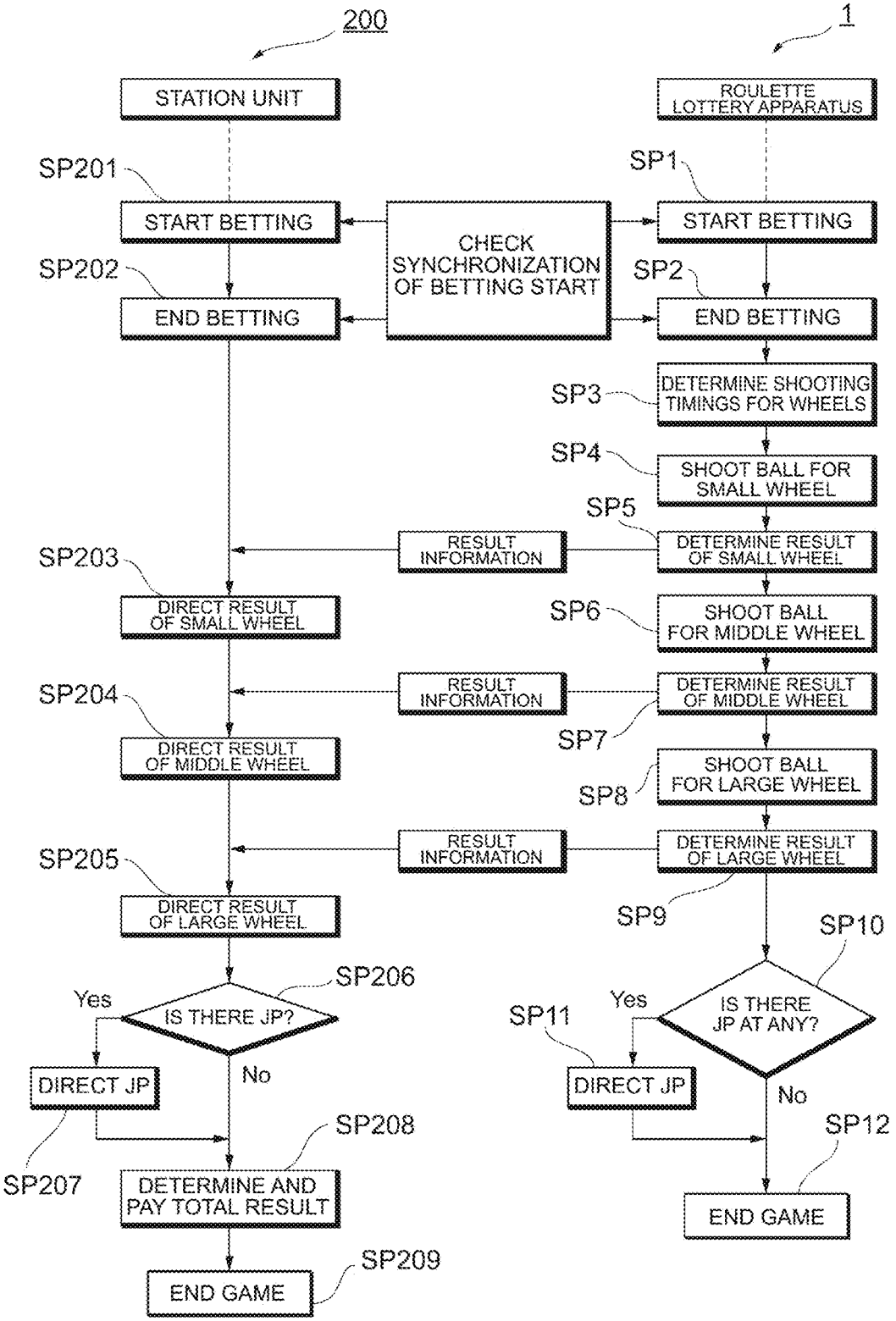
FIG. 28 is a flowchart illustrating a series of operations in the roulette lottery apparatus along with a series of operations in a station unit.

A series of operations in the roulette lottery apparatus 1 according to this embodiment will be described below in conjunction with the flowchart along with a series of operations in the station units 200 (see FIG. 28). In the below description, the large, middle, and small roulette bodies 51 are also referred to as a large wheel (51A), a middle wheel (51B), and a small wheel (51C).

After the betting-enabling time which is determined with synchronization between the roulette lottery apparatus 1 and the station units 200 passes (steps SP1, SP2, SP201, and SP202), the control unit 80 receives a lottery start command via the network 400 and the master unit 300 and determines a ball shooting timing in each wheel (roulette bodies 51) (step SP3).

After the shooting timing is determined, first, the ball 59 in the small wheel is released from the standby state and is shot (step SP4). When the ball 59 falls into any ball pocket 52 and is detected by the ball sensor 58 (where the ball sensor corresponding to the small wheel is referenced by reference sign 58*c* in FIG. 33) disposed on the ball rail 55 side and a winning number is determined as the result in the small wheel (step SP5), the result information is transmitted to the station units 200, is displayed as history information on the game table display unit 203, and is directed as the lottery result in the small wheel (step SP203).

In the roulette lottery apparatus 1, when the ball 59 falls into a ball pocket 52, the small wheel is made to rotate by about one turn in the clockwise direction while causing the LEDs 56 to sequentially flicker so that only the number display section 53 corresponding to the ball pocket 52 looks like shining. When the ball pocket 52 arrives immediately below (at a 6:00 position) after about one turn, the small wheel is stopped and this state is maintained until all the roulette lotteries using the three wheels are ended. In this way, when the ball pocket 52 is maintained immediately below (at the 6:00 position) along with the ball 59, spectators can easily visually recognize the result until all the lotteries are ended (see FIG. 3 and the like).

Subsequently, the ball 59 in the middle wheel is released from the standby state and is shot (step SP6). When the ball 59 falls into any ball pocket 52 and is detected by the ball sensor 58 (where the ball sensor corresponding to the middle wheel is referenced by reference sign 58*b* in FIG. 33) disposed on the ball rail 55 side and a second winning number is determined as the determination result in the middle wheel (step SP7), the result information is transmitted to the station units 200, is displayed as history information on the game table display unit 203, and is directed as the lottery result in the middle wheel (step SP204).

In the roulette lottery apparatus 1, the middle wheel is made to rotate by about one turn in the clockwise direction while causing the LEDs 56 to sequentially flicker so that only the number display section 53 corresponding to a ball pocket 52 into which the ball 59 falls looks like shining. When the ball pocket 52 arrives immediately below (at the 6:00 position) after about one turn, the middle wheel is stopped and this state is maintained until all the roulette lotteries using the three wheels are ended (see FIG. 3 and the like).

Thereafter, the ball 59 in the large wheel is released from the standby state and is shot (step SP8). When the ball 59 falls into any ball pocket 52 and is detected by the ball sensor 58 (where the ball sensor corresponding to the large wheel is referenced by reference sign 58*a* in FIG. 33) disposed on the ball rail 55 side and a third winning number is determined as the determination result in the large wheel (step SP9), the result information is transmitted to the station units 200, is displayed as history information on the game table display unit 203, and is directed as the lottery result in the large wheel (step SP205).

In the roulette lottery apparatus 1, the large wheel is made to rotate by about one turn in the clockwise direction while causing the LEDs 56 to sequentially flicker so that only the number display section 53 corresponding to a ball pocket 52 into which the ball 59 falls looks like shining. When the ball pocket 52 arrives immediately below (at the 6:00 position) after about one turn, the large wheel is stopped. At this time, the winning numbers of the small wheel, the middle wheel, and the large wheel are arranged in a line (see FIG. 3 and the like).

When a jackpot (JP, big win) occurs in any station unit 200 as the determination result of the three winning numbers through the roulette lotteries using the three roulette bodies (Yes in step SP206), jackpot directing is carried out (step SP207). When a jackpot does not occur in any station unit (NO in step SP206), the jack directing is not performed and the determination and payment of the total result is performed (step SP208). Then, the game ends (step SP209). In the roulette lottery apparatus 1, when a jackpot occurs in any station unit 200 (YES in step SP10), the roulette lottery apparatus 1 also performs the jackpot directing (step SP11) and then the game ends (step SP12). An example of the jackpot in the game system 100 according to this embodiment is an event in which the winning numbers in the large, middle, and small roulette bodies 51A, 51B, and 51C are set to the same number.

When the game ends, the large wheel, the middle wheel, and the small wheel are made to rotate in the clockwise direction and the balls 59 are recovered and returned to the standby states. Specifically, when the balls 59 arrive immediately before the ball reset devices 70, the wheels are stopped and the balls 59 are extruded with the ball extruding rods 76 so as to move into the ball release devices 60.

Size of Roulette Lottery Apparatus 1 or the Like

As illustrated in the drawings, the roulette lottery apparatus 1 according to this embodiment is a large-size apparatus which is incomparable for a roulette game and exhibits overwhelming presence. In a general roulette lottery apparatus, since a dealer manually rotates a roulette board, the size of the roulette board or the ball is naturally determined (a value in a certain range) and thus the shape, type, size, and the like of a roulette lottery apparatus are considered to be based on a general notion from such phenomena or backgrounds. In many cases, for spectators considered to have such a general notion, since the roulette lottery apparatus 1 according to this embodiment has a large size and performs roulette lotteries using plural large-size roulette bodies 51 in a state where the surface (rotation plane) is raisable, it is possible to give a novel and strong impression which is completely different from the notions so far.

The specific size of the roulette lottery apparatus 1 is not particularly limited, and for example, the outer diameter X of the largest (that is, the large roulette body 51A) out of the plural roulette bodies 51A, 51B, and 51C can be set to 3 m or more (see FIG. 8). The roulette lottery apparatus 1 is powerful and the movement of the roulette bodies 51 or the balls 59 is conspicuous at far positions. In addition, according to the roulette lottery apparatus 1 having such a large size, it is possible to provide a novel and interesting game giving a sense of unity in which multiple players simultaneously enjoy the same roulette game (a game using a single roulette lottery apparatus 1).

The roulette lottery apparatus 1 preferably implements such a height and a size to attract eyes of players sitting at the station units 200 and persons (spectators) viewing the game in the back or vicinity thereof to the roulette bodies 51 or the balls 59. Although not described in detail in this specification, it is possible to direct a powerful feeling and presence which are completely different from those in the conventional roulette lottery apparatuses by combining visual effects based on various decorative devices (which comprises flickering lighting devices) decorating the roulette lottery apparatus 1 and auditory effects (sound effects).

The above-mentioned embodiment is a preferred example of an embodiment, but an embodiment is not limited to the embodiment and can be modified in various forms without departing from the gist of an embodiment. For example, the light source in the above-mentioned embodiment is formed of the LEDs 56 emitting light to the number display sections 53 through the diffusion by the light-diffusing member 102, but may directly apply light to the number display sections 53. Alternatively, a light source using indirect light such as applying the light to the number display sections 53 after being randomly reflected by a certain reflecting plate may be used. In brief, the light source has only to cause the number display section 53 as the light-irradiated area to look like shining by applying light to the number display section regardless of direct light or indirect light.

LEDs can be preferably used as the light source in terms of responsiveness at the time of turning on and off the light source, but other illumination means may be used as the light source.

The above-mentioned embodiment describes the case where the LEDs 56 as the light source are turned on or off, but the aspect in which a predetermined number display section 53 is caused to look like shining with the progress of a roulette game is not limited to the case. By adjusting light of the LEDs 56 to change the light intensity, the illuminance or brightness of a predetermined number display section 53 may be appropriately changed.

The above-mentioned embodiment describes that the light-diffusing member 102 is disposed on the rotating member 30 side (see FIG. 29 or the like), but may be disposed on the fixing member 20 side (for example, on the LED board 112).

The above-mentioned embodiment describes the example where the rotating apparatus 600 comprising the light-emitting device 700 and the light-blocking body 104 is applied to the roulette lottery apparatus 1 of the game system 100, but this example is only a preferable example of the rotating apparatus 600. The rotating apparatus 600 according to an embodiment may be applied to other game systems comprising a rotating mechanism.

The embodiments of the present disclosure can be suitably applied to a game system such as a roulette lottery apparatus for a roulette game.

DESCRIPTION OF REFERENCE NUMBERS

1: roulette lottery apparatus
2: base
5: camera
6: housing speaker
7: central projector
8: illumination device
9: history display unit
10: support frame (support member)
11: vertical frame
12: horizontal frame
13: front-and-rear frame
14: tilt frame
20: fixing member
21 (21A, 21B, 21C): wheel rail base
22: (plural) bracket
23: wheel rail (annular rail)
23*f*: arc-like fixing member (forming wheel rail)
24: joint (junction between wheel rails)
25: screw
26: adjustment screw
27: output bearing member
28: ball release device-fixing frame
29: ball reset device-fixing frame
30: rotating member
31: carriage
31*a*: base
31*b*: roller
31*c*: pin hole
31*d*: another pin hole
32: annular rotating body
32*b*: arc-like rotating member
32*c*: through-hole
32*d*: another through-hole
33: rotation axis
33*a*: pin
33*b*: washer
33*c*: sleeve
34: fixing pin
35: lubricating member
36: pin gear wheel
40: drive system
41: roulette body drive motor (drive source)
41*a*: output shaft
42: sprocket (pin gear)
43: encoder
50: roulette constituent member
51 (51A, 51B, 51C): roulette body (large roulette body 51A, middle roulette body 51B, small roulette body 51C)
52: ball pocket
52*a*: partitioning blade (ball pocket)
53: number display section
53*s*, 53*t*, 53*u*: light-irradiated area
54: directing illumination for ball revolution
55 (55A, 55B, 55C): ball rail
56: LED (light source)
57: drop-preventing guard
58 (58*a*, 58*b*, 58*c*): ball sensor
59 (59A, 59B, 59C): ball (ball for large roulette body 51A, ball for middle roulette body 51B, ball for small roulette body 51C)
60: ball release device
61: solenoid
61*a*: plunger
62: solenoid sensor
63: roller
64: release sensor
65: setting sensor
66*a*: roller support lever
66*b*: pivot
66*c*: link
66*d*: transmission lever
66*e*: pivot
67: coil spring
68: attachment plate
69: cover plate
70: ball reset device
71: ball reset motor
72: gear train
73: torque limiter
74: ball screw
75: change nut
76: ball extruding rod
76*a*: sensor dog
77: home sensor
78: limit sensor
79: attachment frame member
80: control unit
81: game control unit
81*a*: setting unit
81*b*: determination unit
81*c*: payment unit
81*d*: calculation unit
82: drive system control unit
83: roulette body control unit
84: ball release control unit
85: ball reset control unit
86: display control unit
87: sound control unit
88: illumination control unit
90: storage unit
91: game program
92: betting data
93: reference information
94: payout ratio data
100: game system
102: light diffusing member
104: light-blocking body
104*a*: light-blocking portion
106: light-transmitting member
112: LED board
113: LED base
114: support leg
115: support leg
116: connector
200-N: station unit
201: housing
203: game table display unit
205: operation unit
300: master unit
400: network
500: side monitor
600: rotating apparatus
700: light-emitting device
SB: standby position
X: outer diameter of large roulette body 51A
Y: rising angle of roulette body (angle formed by rotation plane of roulette body and horizontal plane)
Z: rotation center line

The invention claimed is:

1. A rotating apparatus for a game system having a light-emitting device attached thereto, comprising:

a rotating member that rotates on a fixing member;

a drive source that causes the rotating member to rotate;

a plurality of light-irradiated areas that are partitioned and formed in a circumferential direction of the rotating member;

a plurality of light sources that are arranged in an annular shape in the fixing member to configure the light-emitting device and that irradiate the light-irradiated areas with light;

a light-blocking body that is formed in the rotating member in a shape extending in the circumferential direction of the rotating member, and a part of the light-blocking body is formed in a shape protruding from the rotating member to the light sources, so as to prevent the light, with which a specific light-irradiated area as a light irradiation target out of the plurality of light-irradiated areas is irradiated, from leaking into other light-irradiated areas adjacent to the specific light-irradiated area; and a control unit that controls a timing of changing light intensity of the light sources in synchronization with the rotation of the specific light-irradiated area as the light irradiation target, wherein the control unit changes the light intensity of the light sources at the timing of overlapping the light-blocking body with the corresponding light sources when changing the light intensity of the light sources in synchronization with movement of the rotating member.

2. The rotating apparatus for a game system having a light-emitting device attached thereto according to claim 1, wherein a light-transmitting member that transmits a part of light emitted from the light sources is disposed in the light-irradiated areas.

3. The rotating apparatus for a game system having a light-emitting device attached thereto according to claim 2, wherein a light-diffusing member that diffuses light emitted from the light sources is disposed in the light-irradiated areas between the light-transmitting member and the light sources.

4. The rotating apparatus for a game system having a light-emitting device attached thereto according to claim 1, wherein the light-irradiated areas are equally partitioned in the circumferential direction of the rotating member.

* * * * *